United States Patent [19]

Smedberg et al.

[11] Patent Number: 4,860,571

[45] **Date of Patent: * Aug. 29, 1989**

[54] POWER PRESS WITH IMPROVED CUSHIONING SYSTEM

[75] Inventors: Kenneth L. Smedberg, 5 Oak Hill Dr., Crete, Ill. 60417; George J. Bozich, Chicago; Robert J. Kotynski, South Holland, both of Ill.

[73] Assignee: Kenneth L. Smedberg, Crete, Ill.

[ * ] Notice: The portion of the term of this patent subsequent to Mar. 22, 2005 has been disclaimed.

[21] Appl. No.: 100,765

[22] Filed: Sep. 24, 1987

Related U.S. Application Data

[63] Continuation-in-part of Ser. No. 912,332, Sep. 26, 1986, Pat. No. 4,732,033, and a continuation-in-part of Ser. No. 6,732, Jan. 22, 1987, Pat. No. 4,825,681, and a continuation-in-part of Ser. No. 21,981, Mar. 5, 1987, Pat. No. 4,736,615, and a continuation-in-part of Ser. No. 55,687, May 29, 1987, Pat. No. 4,796,460.

[51] Int. Cl.[4] ..... B21D 24/02

[52] U.S. Cl. ..... 72/453.13; 72/344; 267/119; 267/122; 267/130

[58] Field of Search ..... 72/453.13, 347, 348, 72/349, 344, 456, 453, 350, 465; 267/118, 119, 122, 130, 64.19, 64.20, 64.25, 64.24, 64.27, 64.29; 100/214, 259, 267

[56] References Cited

U.S. PATENT DOCUMENTS

| | | | |
|---|---|---|---|
| 2,773,686 | 12/1956 | Nash | 267/64.23 |
| 2,827,283 | 9/1958 | Brown et al. . | |
| 2,878,012 | 3/1959 | Crites | 267/122 |
| 2,887,069 | 5/1959 | Lich | 267/64.23 |
| 2,902,291 | 9/1959 | Walker . | |
| 2,999,682 | 9/1961 | Stump | 267/65 |
| 3,115,676 | 12/1963 | Quartullo | 18/16 |
| 3,295,846 | 1/1967 | Robertson | 267/122 |
| 3,488,045 | 1/1970 | Balunas, Jr. et al. | 267/119 |
| 3,511,491 | 5/1970 | Kraft | 267/119 |
| 3,667,707 | 6/1972 | Mui | 267/122 |
| 3,776,020 | 12/1973 | Fedosenko et al. | 72/445 |
| 3,834,216 | 9/1974 | Shiller et al. | 72/441 |
| 3,914,975 | 10/1975 | Kawano | 72/389 |
| 3,989,232 | 11/1976 | Steinbach et al. | 267/122 |
| 4,148,200 | 4/1979 | Bessho | 72/441 |
| 4,291,571 | 9/1981 | Claussen | 72/453.18 |
| 4,597,475 | 7/1986 | Lassig et al. | 267/122 |
| 4,657,229 | 4/1987 | Thurow | 267/122 |

FOREIGN PATENT DOCUMENTS

| | | | |
|---|---|---|---|
| 841379 | 4/1952 | Fed. Rep. of Germany | 267/122 |
| 1294334 | 5/1969 | Fed. Rep. of Germany . | |
| 2515295 | 4/1983 | France | 267/122 |
| 131850 | 10/1981 | Japan | 267/122 |
| 153134 | 11/1981 | Japan | 267/122 |
| 0338034 | 9/1981 | U.S.S.R. . | |
| 1031617 | 7/1983 | U.S.S.R. . | |
| 1191308 | 11/1985 | U.S.S.R. | 100/259 |

*Primary Examiner*—David Jones
*Attorney, Agent, or Firm*—Anthony S. Zummer

[57] ABSTRACT

A power press used for metal working is provided with a cushioning system. During the operation of a press, abrupt changes in the velocity of certain moving parts of the press may damage or cause rapid wear to parts. The present invention utilizes pneumatic bellows actuators. A hydraulic snubber and snubber-intensifier having closed systems are in combination with a pneumatic bellows actuated die cushion. The snubber has a piston within a cyliinder assembly. During the upward stroke of the ram of the press, the movable plate of the die cushion is held back by the piston so as to prevent a damaging impact on the movable die parts and workpiece supported by an air cushion. Fluid is allowed to flow from the top of the piston through a flow valve to return to a reservoir within the die cushion or to the bottom of the cylinder. During the downstroke the piston causes an increase in pressure in the oil below the piston, which flows out through a flow control valve so as to increase the force holding the work in the die. A programmable controller may be used to control the valves to produce a desired program of piston upward motion and oil pressure below the piston during the downstroke.

29 Claims, 17 Drawing Sheets

FIG. 6
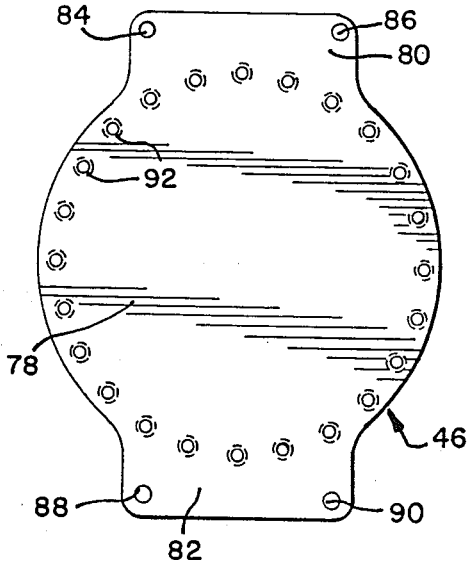
FIG. 7
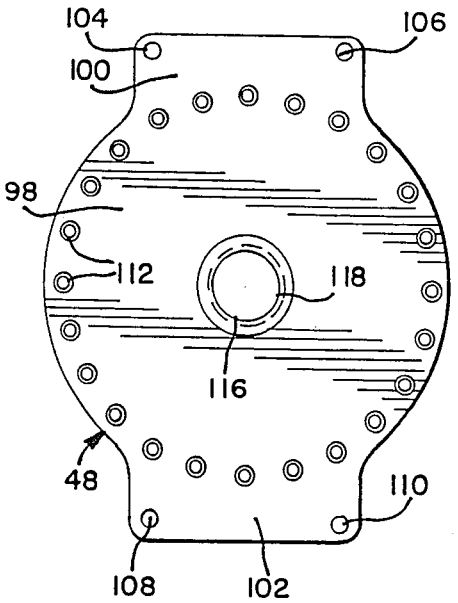
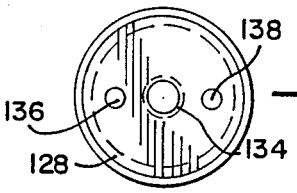
FIG. 8
FIG. 9
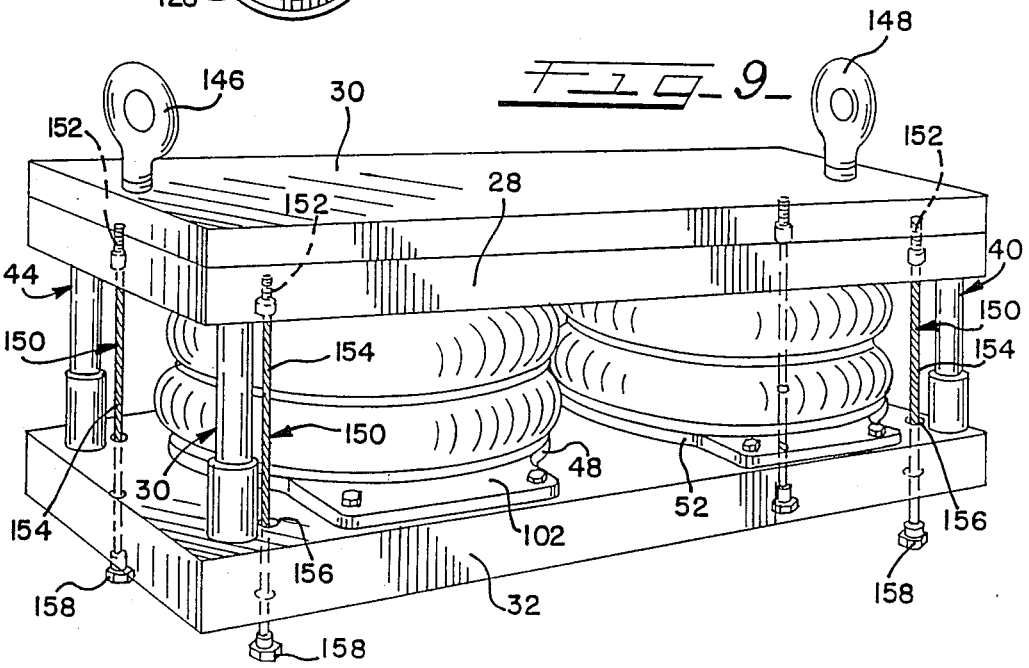

POWER PRESS WITH IMPROVED CUSHIONING SYSTEM

This application is a continuation-in-part of Ser. No. 912,332, filed Sept. 26, 1986, now U.S. Pat. No. 4,732,033; and a continuation-in-part of Ser. No. 006,732, filed Jan. 22, 1987, now U.S. Pat. No. 4,825,681; and a continuation-in-part of Ser. No. 021,981, filed Mar. 5, 1987, now U.S. Pat. No. 4,736,615; and a continuation-in-part of Ser. No. 055,687, filed May 29, 1987, now U.S. Pat. No. 4,796,460.

This invention relates to power presses used for forging, stamping and forming metal workpieces and specifically to improvements in cushioning systems used for modifying the forces which act upon the ram, die set and workpiece.

The cushioning system includes, singly or in combination, elements which are commonly known as die cushions, snubbers, intensifiers, and counterbalances which act during the upward and downward motion of the ram to reduce destructive stresses on the press, dies and work, which are produced during the operation of the press, and thus prevents or limits rapid wear and damage to the press dies and workpiece.

BACKGROUND OF THE INVENTION

Power presses are built in a wide variety of styles and sizes and those presses have a variety of applications, such as, forging, stamping, drawing, or other functions. A common construction of a power press is a double action press which combines the functions of blank holding with drawing. In many stamp and drawing operations, it has been found to be desirable to provide a die cushion which holds a blank to allow the metal of the blank to flow during working. A die cushion is often used to eject a worked blank. Die cushions come in various forms. A well known form is a rubber tankless type. Another well known form is a piston type which is an air cylinder assembly.

Die cushions utilizing an air cylinder assembly are generally a typical air cylinder construction having a cylinder and a piston movable relative to the cylinder. The construction of the air cylinder, as is conventional, utilizes various types of seals and packings to retain the air under pressure. The constant movement of the piston in the cylinder often results in wear in the seals and packing so that there is a constant loss of air from the cylinder, thereby causing the air to be wasted. The loss of air causes a needless operating cost in the operation of a press having an air cylinder die cushion. Importantly, the loss of air causes a variance in the holding force of the air cylinder resulting in a variance in the product produced by the press. In some instances, the variance causes some of the product to be unusable and thus be scrap.

The constant impact loading on a power press and die cushion causes wear to occur in the press and die cushion. It follows that it becomes necessary to maintain and repair the press as well as the die cushion. A desirable construction of a die cushion is one wherein the die cushion may be easily disassembled for maintenance or repair or the die cushion may be easily removed as a unit. Furthermore, it is desirable to provide a die cushion which has substantially no wear or air loss in operation.

In order to counterbalance the weight of the ram and its components and die members attached, and to take up the clearance in the main bearings and backlash in the gears thereto most presses are provided with a counterbalance. Traditionally the counterbalance utilized an air cylinder and piston as its major element. The constant movement of the piston in the cylinder often results in wear in the seals and packing utilized to retain the air under pressure, with the result that there is a constant loss of air from the cylinder. A typical construction for such a counterbalance is disclosed in U.S. Pat. No. 2,084,066, issued June 15, 1937, to F. J. Rode et al., entitled, "Metalworking Press". The Rode metalworking press utilizes a pneumatic cylinder embodying piston rods connected to pistons within cylinders to act as counterbalancing devices. The use of various additional systems for counterbalancing various presses is shown in the following patents: U.S. Pat. Nos. 1,970,134, issued Aug. 14, 1934, to W. Ferris, entitled, "Hydraulic Press"; 2,483,597, issued Oct. 4, 1949, to C. E. Schogren, entitled, "Supplemental Forging Press Die"; 3,115,676, issued Dec. 31, 1963, to O. F. Quartullo entitled, "High Speed Forging Apparatus"; 3,776,020, issued Dec. 4, 1973, to Fedosenko et al., entitled, "High-Speed Pressing Machine"; 3,834,216, issued Sept. 10, 1974, to Schiller et al, entitled, "Forging Press"; 3,914,975, issued Oct. 28, 1975, to Kawano, entitled, "Hydraulic Press Brake"; 4,148,209, issued Apr. 10, 1979, to Bessho, entitled, "Forging Press"; and 4,291,571, issued Sept. 29, 1981, to Claussen, entitled, "Forging Press". In addition, West German Auslegeshrift No. 1294 334, published May 8, 1969, discloses a cylinder construction for use with a press, as does USSR Publication Nos. 338034 and 1031617, of Sept. 15, 1981 and July 30, 1983, respectively.

Power presses are built in a wide variety of styles and sizes, and those presses have a variety of applications. In many applications, a press is used to operate at a high rate. The press moves quickly in its pressing stroke and moves at substantially the same rate in its return stroke. As is well known, die cushions are used as a work holding device or part ejector. The cushion which is used in certain instances includes a resilient bellows or actuator. The actuator receives a compressible fluid such as air, so that the lower portion of the die may travel a selected distance with the ram during the pressing operation.

Once the actuator of the cushion is compressed, and the ram starts its return stroke, the cushion moves the movable portion of the die with it, disengaging the workpiece. The die cushion actuator moves the movable portion of the die with a constant acceleration until the movable portion of the lower die is at its rest position. The lower portion of the die is provided with a stop which causes an abrupt halt to the movement of the die. This abrupt halt causes an impact loading on that portion of the die connected to the cushion and associated parts. The repeated impact loading on the parts of the die often causes damage to those parts.

It is desirable to provide a die cushion construction for use in a press wherein the stopping of the die is not an abrupt stop, but rather a substantially smooth stop, which reduces damage to the die by impact loading on the die. This construction also reduces damage to the press and the die cushion itself.

The object of this invention is to provide a power press with improved cushioning systems which do not require sliding seals to prevent the leakage of fluids from the system.

Another object is to provide a cushioning system which does not leak fluids from the system.

Another object is to provide a cushioning system which reduces shock, noise and excessive impact on the dies.

Another object is to provide a system which is more dependable and consistent in its operation and does not require lubrication.

Another object is to provide a system in which there are no variable frictional forces.

The present invention has for an object the slowing down of the die cushion during the final portion of its return stroke.

The invention has the further object of controlling the rate at which the cushion is stopped in its motion.

A further object is to provide a means by which the deceleration of the cushion may be varied during its stroke.

Another object is to provide a means whereby the cushion may be easily removed and replaced whenever maintenance service is required.

Another object is to provide a hydraulic snubber, to act in conjunction with a die cushion, which does not require any high pressure hydraulic seals in conjunction with its moving parts.

Another object is to provide cushioning systems which are less in weight and less in cost than piston type systems.

Another object is to provide cushioning systems which require very little maintenance.

Another object is to provide a cushion intensifier to increase the force holding the workpiece and vary the force while forming the workpiece during the downward motion of the ram.

Another object is to reduce the chance for parts to be misaligned in position or damaged when they are being separated from the fixed die after the drawing operation.

An ancillary object is to reduce the cost of die maintenance and to provide for a more consistent and uniform pressing operation.

SUMMARY OF THE INVENTION

The present invention relates to improvements in power presses and specifically to improvements in die cushions, counterbalances, snubbers and intensifiers which are important components of power presses.

The die cushion includes a pair of substantially parallel spaced flat plates resiliently spaced from each other by a resilient pneumatic bellows mounted between the plates. A plurality of limiter pins is releasably secured to one of said spaced plates. Each of the limiter pins has a threaded end threadedly mounted in said plate. The other plate is movable relative to the plurality of limiter pins. The other end of each of the limiter pins is threaded and has a nut mounted thereon to limit the movement apart of the spaced plates. A limit sleeve is mounted on each of the limiter pins controlling the movement of the plates toward each other to define a minimum spacing between the bellows between the plate. A quick change adaptor plate is fixed to one end of the bellows. The quick change adaptor plate has a pair of opposed outwardly extending ears. Means releasably secure the ears of the adaptor plate to one of said flat plates to secure that end of the bellows to that flat plate. A second quick change adaptor plate is fixed to the other end of the bellows. The second quick change adaptor plate has a pair of second opposed ears. Second means releasably secure the second ears of the second adaptor plate to the other of the flat plates to secure the other end of the bellows to the other of the flat plates.

The herein disclosed invention includes a pneumatic press counterbalance. The counterbalance holds certain parts of a press in the same relative engagement during the return stroke of a ram as during the power stroke of that ram. The counterbalance actuator is constructed of several resilient pneumatic bellows having opposed open ends. The bellows are connected in tandem by means of bellows connectors, interposed between the open ends of adjacent bellows to which the bellows are sealingly attached. The counterbalance has a fixed plate to which one of the open ends of the bellows actuator assembly is sealingly connected. The fixed plate is fastened to the fixed part of the press. A movable plate is sealingly connected to the other open end of the bellows actuator assembly. The movable plate is connected to one end of a connecting rod whose other end is connected to the ram. When the ram moves downward the movable plate moves towards the fixed plate. Movement of the movable plate toward the fixed plate compresses air within the resilient pneumatic bellows. When the movable plate moves away from the fixed plate, the air compressed in the bellows urges the movable plate away from the fixed plate to hold certain parts of the press in the same relative engagement as during the movement of the movable plate toward the fixed plate.

A second form of counterbalance utilizes a resilient tubular bellows and attaches its movable plate directly to the ram and its fixed body of the press.

The die cushion includes a fixed plate connected to a base of the press. A resilient cushion bellows or actuator has one end sealingly connected to the fixed plate. The cushion actuator has an opposite end sealingly connected to a movable plate. The movable plate is adapted for connection to a portion of a die mounted in the press. A resilient snubber bellows or actuator has one end fixed relative to the fixed plate. The snubber actuator has an opposite movable end connected to a snubber movable plate. The snubber movable plate is connected to the first mentioned movable plate by a plurality of limiter rods. The snubber actuator affects the rate of movement of the cushion movable plate away from the snubber actuator. The snubber actuator has means for allowing fluid to flow into the snubber actuator when the cushion movable plate moves toward the snubber actuator.

An alternate snubber assembly comprises an oil reservoir assembly and reservoir closure assembly holding a movable rod and plunger assembly which is attached by means of a swivel assembly to the movable plate of the die cushion. When the movable plate moves downward, the plunger moves freely through the fluid. When the movable plate of the die cushion moves upward, it moves freely until it is close to the end of its stroke, at which point the plunger enters a confined cylindrical space, which is filled with fluid so that its motion is restricted by the rate at which the fluid can flow from the confined space into the die cushion through an orifice at the top of the confined space in the reservoir closure assembly. The fluid passes through a metering valve which controls the rate of flow and is then returned through a conduit to the bottom of the cylinder.

For certain pressing operations, it has been found desirable to vary the force which is exerted by the air cushion on the underside of the workpiece during the forming of the workpiece. For these applications the snubber construction includes an intensifier. In this construction, the assembly functions as a snubber during the upward stroke of the press. During the downward stroke the piston is moved downward by the action of the ram and creates a high unit pressure in the oil confined in the lower part of the cylinder, which pressure depends upon the rate at which oil is allowed to leave the cylinder. The oil pressure is controlled within reasonable limits by allowing the oil to flow out of the cylinder and return to an oil reservoir through an adjustable flow valve, which controls the rate of flow of oil out of the cylinder. The flow valve may be continuously varied during the down stroke in accordance with a desired program in order to provide a desired program of force versus ram position. This variable force is added to the force exerted by the die cushion and results in improved products due to better control of the forming operation.

BRIEF DESCRIPTION OF THE DRAWINGS

FIG. 6 is a plan view of an upper adaptor plate of the cushion die shown in FIGS. 1 and 2.

FIG. 7 is a plan view of a lower adaptor plate of the die cushion of FIGS. 1 and 2.

FIG. 8 is an end elevational view of a limiter pin.

FIG. 9 is a perspective view of the cushion die of FIGS. 1 and 2, with restraining cables connected to a pair of opposed plates.

DESCRIPTION OF THE PREFERRED EMBODIMENT

Figure 1:
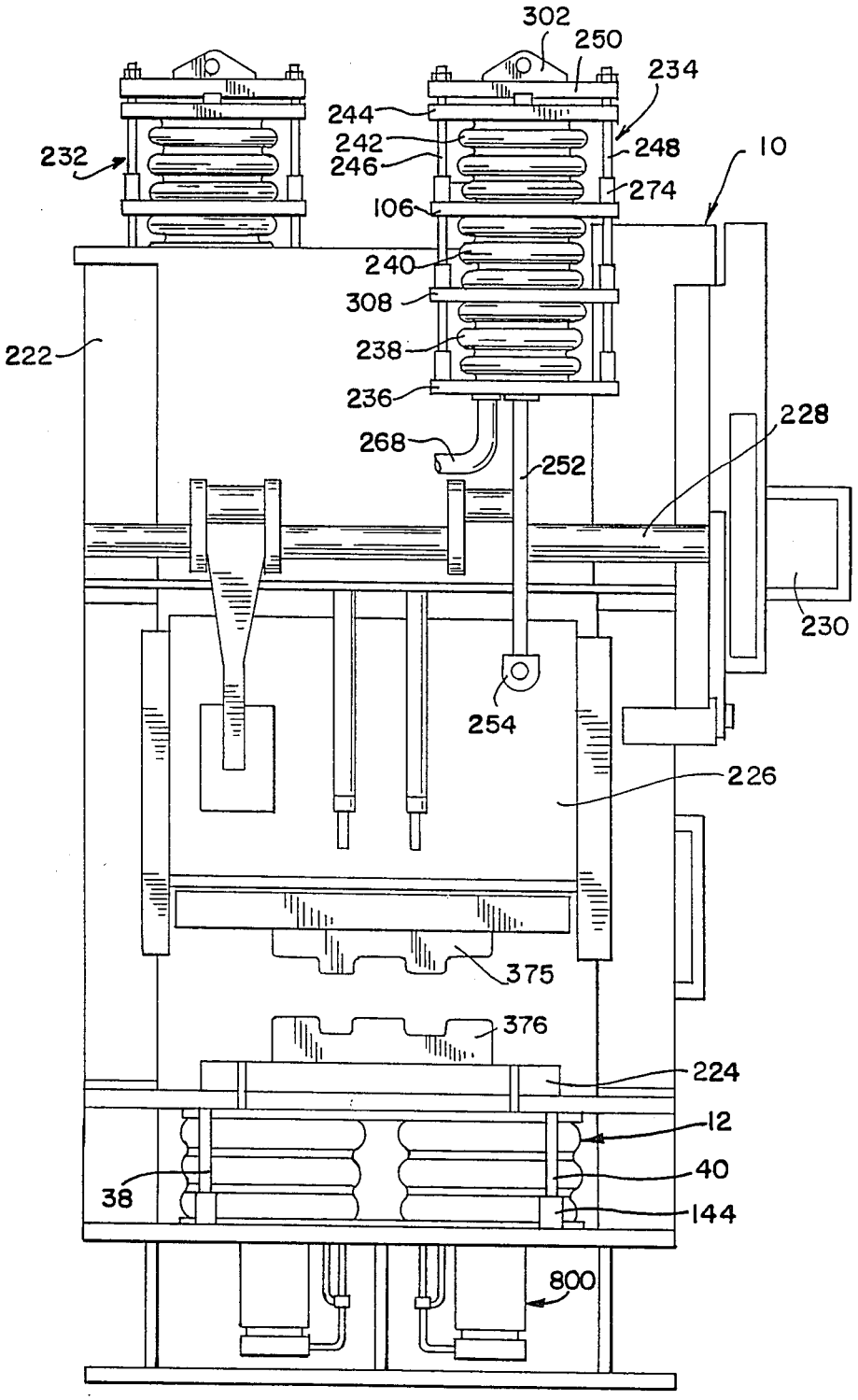
FIG. 1 is a perspective view of a conventional power press with a portion of the press broken away in order to show the components embodying the herein disclosed invention mounted within and on the press.
Figure 2:
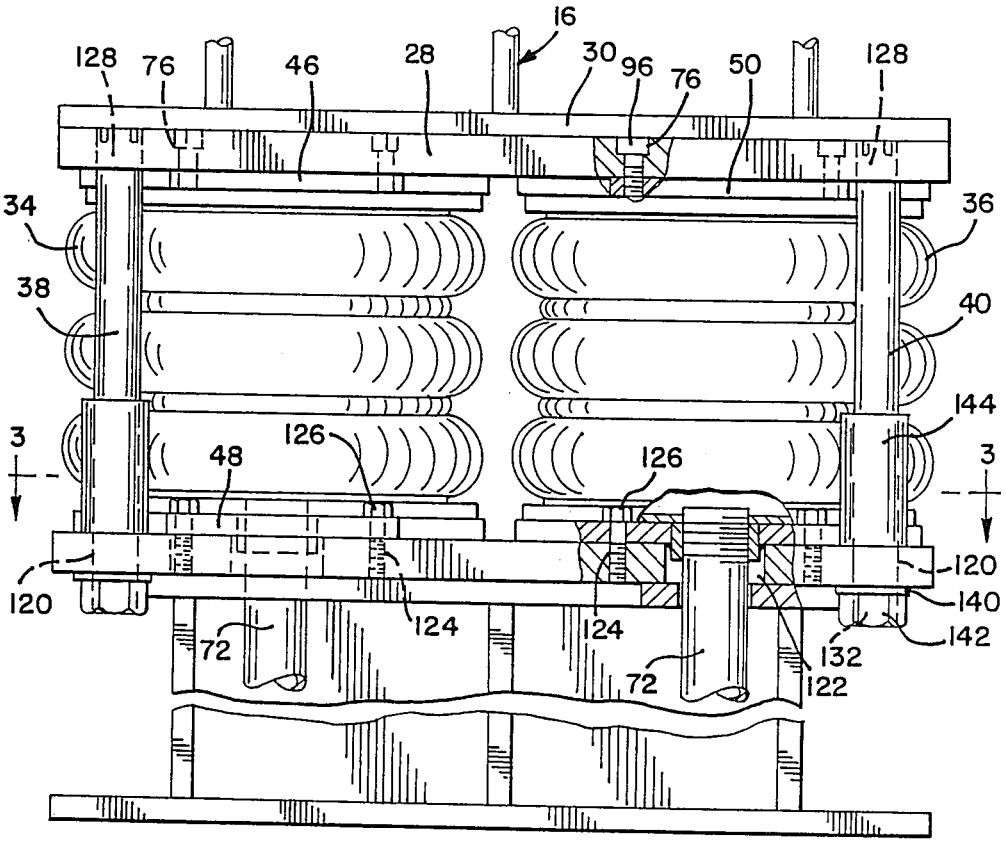
FIG. 2 is an enlarged side elevational view of the cushion die shown in FIG. 1.
Figure 3:
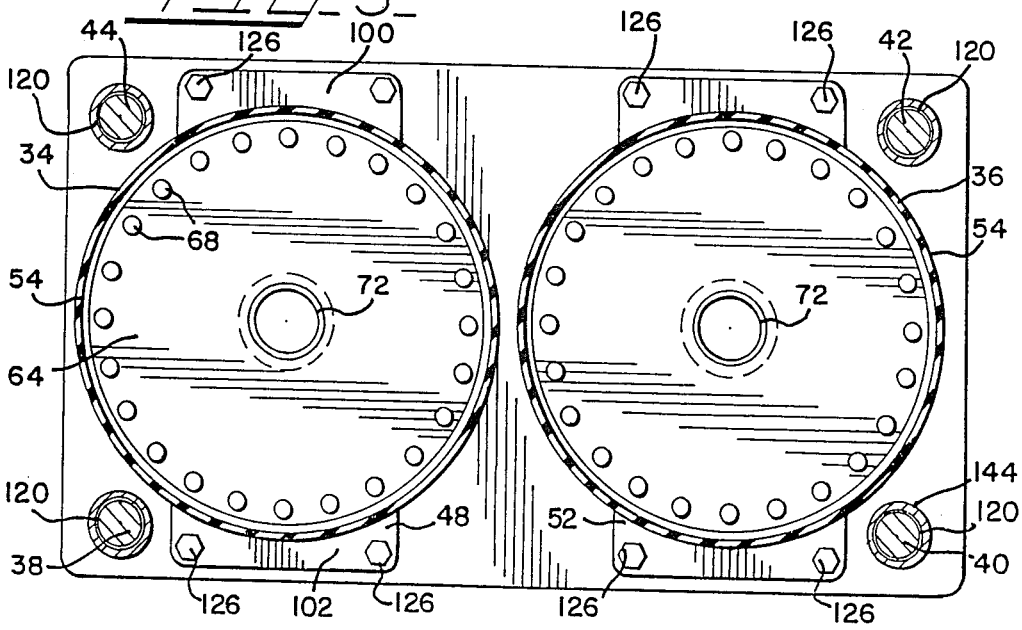
FIG. 3 is a cross sectional view taken on Line 3—3 of FIG. 2.
Figure 4:
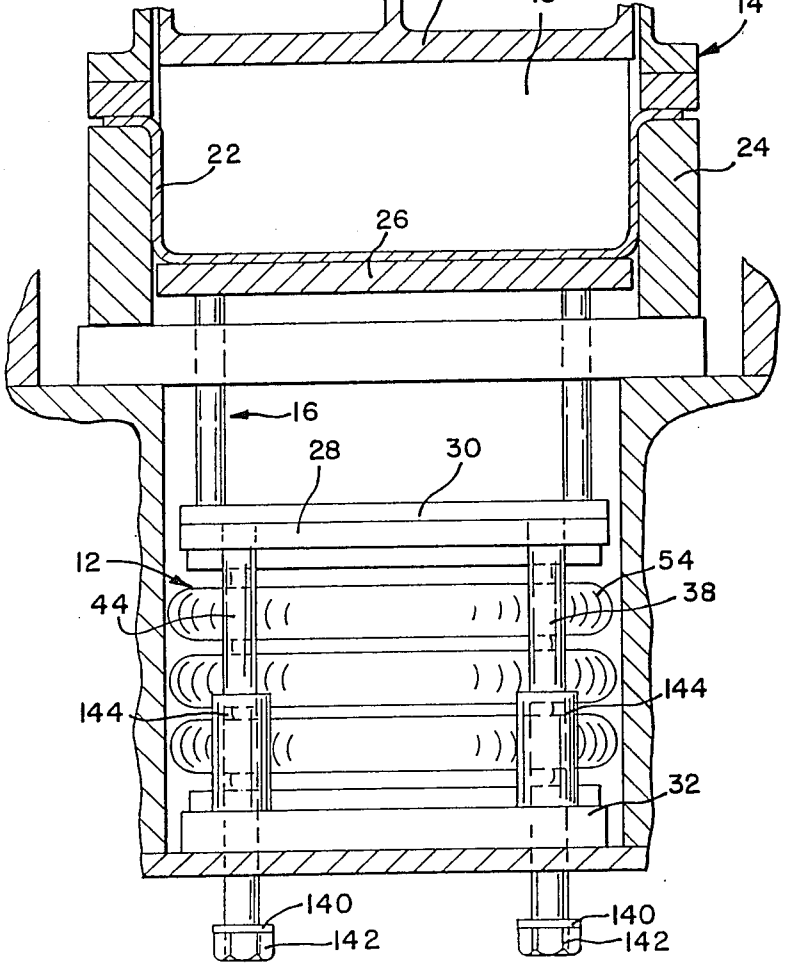
FIG. 4 is an enlarged cross sectional view of a portion of the press shown in FIG. 1 showing a portion of a die with a blank within the die.

Referring now to the drawings, a conventional power press 10 is shown in FIG. 1. The power press 10 has a pneumatic die cushion 12, and snubber and intensifier 800, mounted in a die well of the power press. A pair of counterbalances 232 and 234 are mounted suitably to the frame and ram of the press. As may be seen in FIG. 4, the die cushion 12 is connected to a conventional drawing die 14 through a support 16.

Die 14 is a conventional die which includes a male portion 18 connected to a ram 20 of the press. A metal blank 22 is mounted in a female portion 24 of the die. The female portion includes a movable base 26 which is connected to die cushion 12 by conventional support 16. Die cushion 12 includes an upper plate 28 with a conventional striker plate 30 bolted to the upper plate (the bolts are not shown in the drawings). A lower plate 32 is spaced from the upper plate 28. A pair of resilient conventional bellows 34 and 36 resiliently space the plates from each other. Four limiter pins 38, 40, 42 and 44 hold the plates substantially parallel to each other. Bellows 34 has its upper end secured to an upper quick change adaptor plate 46 which in turn is releasably secured to upper plate 28. Bellows 34 has its lower end secured to a lower quick change adaptor plate 48, which is releasably secured to the lower plate 32. Bellows 36 has its upper end secured to an upper quick change adaptor plate 50 which is identical in construction to adaptor plate 46. Adaptor plate 50 is releasably secured to upper plate 28. Bellows 36 has its lower end secured to lower quick change adaptor plate 52 which is identical to adaptor plate 48. Lower adaptor plate 52 is releasably secured to lower plate 32.

Bellows 34 and 36 are identical in construction to each other. Each of the bellows includes a boot 54 with a pair of rings 56 mounted thereon. The boot has a top cap 58 secured to the upper end of the boot with a seal 60 to provide a sealing engagement between the top cap and the upper end of the boot. The top cap has twenty-four fastener receptacles 62 arranged in a circle. Each of the receptacles 62 has an internal thread. The bottom cap 64 is mounted on the bottom of each boot and is sealingly connected to the boot through an annular seal 66. The bottom cap has twenty-four fastener receptacles 68 arranged in a circle. Each of the fastener receptacles 68 has an internal thread. Bottom cap 64 includes a pipe aperture 70 for receiving an air inlet pipe 72. Upper plate 28 is a generally rectangular plate having a uniform thickness. Four threaded guide pin apertures 74 are formed in the plate. Each of the guide pin apertures is adjacent to a corner of the plate. The upper plate also contains eight screw receptacles 76.

Figure 5:
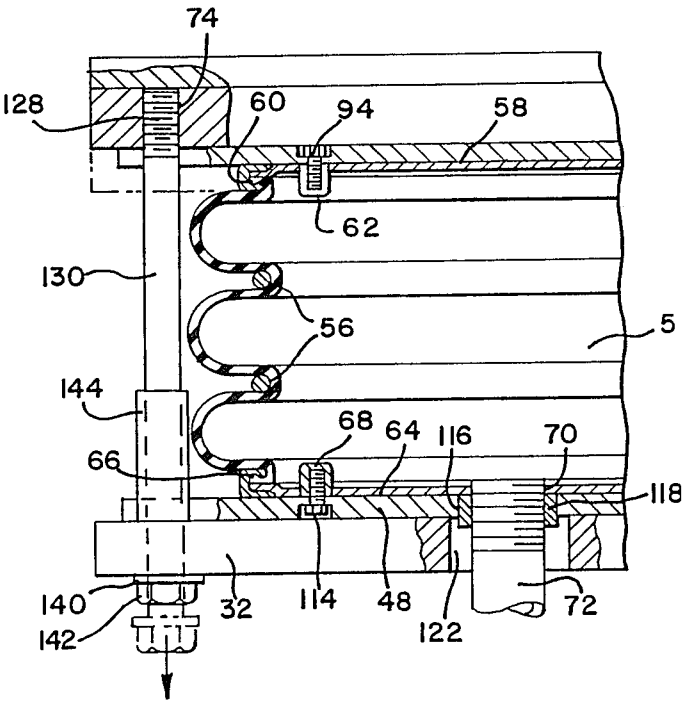
FIG. 5 is a partial cross sectional view of a portion of the die cushion showing a portion of a bellows.

The upper quick change adaptor plate 46 is identical to the other upper quick change adaptor plate 50. Adaptor plate 46 is shown in FIG. 6. Adaptor plate 46 is a substantially flat steel plate having a base portion 78 with an ear 80 formed on one side and an ear 82 formed on the side opposite ear 80, so that the ears extend outwardly from each other from the base portion. A pair of internally threaded holes 84 and 86 is formed in ear 80. A second pair of internally threaded holes 88 and 90 is formed in ear 82. The holes 84, 86, 88 and 90 are positioned to align the four holes 76 in the upper plate 28. Adaptor plate 46 contains twenty-four holes 92 which are arranged in a circle, which holes 92 are each aligned with a respective internally threaded receptacle 62. Each of the holes 92 is drilled and countersunk to receive a machine screw 94 as shown in FIG. 5. Upper adaptor plate 46 is secured to top cap 58 on the upper end of the bellows by twenty-four machine screws 94 positioned in holes 92 and threadedly mounted in the internally threaded receptacles 62, so that adaptor plate 46 is secured to the cap. Four machine screws 96 are positioned in the holes 76 in the upper plate and threadedly engage the internally threaded holes 84, 86, 88 and 90 to secure the adaptor plate to upper plate 28.

Lower adaptor plate 48 is shown in FIG. 7. Lower adaptor plate 48 is identical to lower adaptor plate 52. Lower adaptor plate 48 includes a base portion 98 with an ear 100 formed integral with one side of the base portion. An ear 102 is formed integral with the base portion opposite to ear 100 so that the ears extend outwardly from each other. Ear 100 has a pair of holes 104 and 106 formed therein. Ear 102 has a pair of holes 108 and 110 formed therein. The base portion has twenty-four holes 112 arranged in a circle which holes 112 may be aligned with respective threaded receptacles 68 of bottom cap 64. Holes 112 are countersunk to receive screws 114 to secure bottom adaptor plate 48 to bottom cap 64. The bottom adaptor plate contains an aperture 116 with a collar 118 aligned with the aperture. The collar is internally threaded to receive pipe 72 and is aligned with opening 70.

Bottom plate 32 is similar to the upper plate 28. Bottom plate 32 is rectangular in shape and has four holes 120 formed in its four corners. Holes 120 are aligned with threaded holes 74 of upper plate 28. Bottom plate 32 contains a pair of pipe apertures 122 to receive pipes 72 connected to bellows 34 and 36. The lower plate includes eight threaded screw apertures 124, four of which are alignable with the apertures 104, 106, 108 and 110 of bottom adaptor plate 48 and remainder with like apertures of bottom adaptor plate 52. Screws 126 are mounted in holes 104, 106, 108 and 110, and are threadedly mounted in apertures 124 to secure releasably bottom adaptor plate 48 to lower plate 32.

Each of the limiter pins 38, 40, 42 and 44 is identical in construction to each of the other limiter pins. Each limiter pin has at one end a threaded portion 128 which is threadedly mounted in each of the threaded apertures 74 of upper plate 28. Each limiter pin has a cylindrical body 130 with a threaded portion 132 at the other end for receiving a stop means. The upper end of each limiter pin has a wrench receptacle portion on the end of the limiter pin having the threaded portion 128. The receptacle portion includes an internally threaded opening 134 in the center with a pair of holes 136 and 138 on a straight line with center hole 134. These openings provide a means for connecting a wrench to the end of the limiter pins when the limiter pin is connected to the upper plate.

The stop at the other end of the limiter pin includes a conventional washer 140 mounted on threaded end 132 and a conventional nut 142 mounted on threaded portion 132 holding the washer in place.

A limit sleeve 144 is slidably mounted on the body of each limiter pin. Each limit sleeve is of sufficient height to prevent bellows 34 and 36 from being damaged when plates 28 and 32 are moved toward each other. Limit sleeves 144 define a minimum spacing between the plates so that when the bellows are collapsed, there is no danger or any damage to the bellows.

The operation of press 10 is conventional in that upon activation, ram 20 moves down toward blank 22, so that male portion 18 of the die engages the blank; the blank engages bottom 26 and bottom 26 is connected to the striker plate by conventional connector 16. The striker plate is connected to the upper plate 28 by conventional bolts which are not shown. Bottom 26 is supported by the two bellows 34 and 36. The bellows offer a selected resistance to the downward movement of the bottom 26 against the force of the ram to hold the blank between the bottom 26 and the male die as is conventional. As upper plate 28 moves downward, the limiter pins slide in limit sleeve 144 and in openings 120 in the bottom plate. Air contained in the bellows is restricted to the bellows and none of the air escapes, but rather is compressed and pushes the boots outward. The bellows are strengthened by rings 56. In the event of loss of air pressure, the downward movement of plate 28 is limited by limit sleeves 144 so that the boots are not crushed.

It may be appreciated that the resistance offered by the bellows is controlled mainly by the pressure of the air contained in the bellows. The air pressure may be regulated by the introduction or removal of air from the bellows through pipes 72, as is conventional and well known. Pipes 72 are connected to a conventional source of compressed air through a conventional air regulator, which regulator and source is not shown herein.

As is conventional with many power presses, the well of the press does not have any convenient means for getting into the well other than through the top opening once the press is set up. The construction of the present die cushion is such that repairs and maintenance may be easily accomplished. In order to repair the die cushion or to replace the boot, the present construction allows a simple and easy method of making the replacement or repair.

In order to repair the present die cushion, die 14 is removed, as is conventional, along with connector 16, thereby exposing striker plate 30. The bolts securing the striker plate to the upper plate 28 are loosened to remove the striker plate from the upper plate. A wrench is inserted in the end of each of the limiter pins to turn the limiter pins, and thereby loosen each of the limiter pins from the upper plate allowing the limiter pins to drop down. Screws 96 are then removed from engagement with the upper adaptor plates. It may be appreciated that there are only four screws for each of the quick change adaptor plates. Once the screws 96 are removed, the upper plate may be lifted off the upper quick change adaptor plates. Also, it may be appreciated that screws 126 are thus exposed so that those screws may be easily loosened, requiring only four screws to be loosened, thus, releasing the lower quick change adaptor plate from bottom plate 32. Each of the bellows with the quick change adaptor plates may then be lifted. In each instance, pipe 72 is lifted and may be disconnected from the adaptor plate. Thus, each bellows with the adaptor plates may be lifted out of the well for servicing. In the event that it is necessary to replace the boots, a new bellows with the quick change adaptor plates is positioned in place, and pipe 72 is attached to the new bellows. Four screws 126 are only required to secure the bottom adaptor plate to the lower plate for each bellows. Screws 96 are then secured to the upper adaptor plate through upper plate 28 to secure the upper adaptor plate to the upper plate. The limiter pins are then threadedly positioned in each of the respective threaded openings 74 and are threadedly connected thereto. The striker plate is then reconnected to the upper plate. Compressed air is introduced into the bellows. The bellows are then extended and the stops limit the upward movement of the upper plate.

It may be appreciated that in certain instances, it is desirable to provide means for removing the entire unit from the well. In those instances, a pair of eyebolts 146 and 148 are mounted in striker plate 30. Thus, the die cushion is lifted by eyebolts 146 and 148. It may be appreciated that the utilization of the eyebolts allows the ram of the press to lift the die cushion from the well.

Four identical restraining cables 150 are secured to upper plate 28 and extend through lower plate 32 to provide a safety restraint between plates 28 and 32. Each of the restraining cables includes a threaded mounting head 152 threadedly mounted in the underside of upper plate 28. A high-strength steel cable 154 has one end fixed to mounting head 152. Steel cable 154 is freely movably mounted in a cable opening 156 in lower plate 32. Steel cable 154 has a cable stop 158 fixed to its other end. In the event that the limiter pins should break loose so that the bellows would push plates 28 and 32, the restraining cables would prevent the plates 28 and 32 from flying apart.

Looking now to FIGS. 1 and FIGS. 10 through 16, the specific construction of counterbalance 234 is shown therein. Counterbalance 234 discloses a specific improved cushion construction. Counterbalance 234 generally includes a fixed plate 236 which is fixed to frame 222 of the power press. Three identical resilient pneumatic bellows 238, 240 and 242 are supported on the fixed plate. Each of the bellows has a pair of opposed open ends. A movable plate 244 is sealingly connected to one end of bellows 242. Two identical limiter pins 246 and 248 are fixed at one end of each pin to fixed plate 236. A head plate 250 is fixed to the other end of each of the limiter pins to hold the limiter pins parallel to each other. A connector rod 252 has one end fixed to movable plate 244. The connector rod extends slideably through fixed plate 236 and includes a connector eye 254 on one end which connector eye connects that end of the connector rod to ram 226.

Fixed plate 236 generally includes a flat circular body 256 with a pair of identical ears 258 and 260 formed integral with the outer periphery of circular body 256. Ears 258 and 260 include pin apertures 262 and 264 which receive fixedly limit pins 246 and 248, respectively. Body 256 includes an air inlet port 266 which receives an air inlet pipe 268. The air inlet pipe is connected to a conventional source of compressed air through a conventional regulator valve, none of which is shown herein. Body 256 includes a rod aperture 270 which is positioned in the center of the body. A bearing 272 is mounted in the rod aperture. A seal 274 is mounted in the bearing and is engageable with the connector rod 252 which is movably mounted in bearing 272. As is conventional, the seal forms an air seal between the bearing and the connector rod.

Movable plate 244 includes a flat circular body 276. Body 276 has a pair of ears 278 and 280 formed integral with the outer periphery thereof so that the construction of body 276 is similar to that of fixed plate 236. Ears 278 and 280 include pin apertures formed therein which slideably receive limit pins 246 and 248, respectively, to limit movement of the movable plate to a substantially straight line movement parallel to the limit pins. Body 276 includes an aperture 282 formed in its center to receive fixedly connector rod 252.

Connector rod 252 includes a shaft portion 284 with a reduced mounting portion 286 on one end. The mounting portion is mateably received in aperture 282. A nut 288 is threadedly mounted on a threaded portion 290 of the connector rod to secure the connector rod to movable plate 244. The other end of the connector rod has a threaded portion 292. The mounting eye is threadedly mounted on threaded portion 292.

Head plate 250 includes a flat circular head plate body 294 with ears 296 and 298 formed integral with the outer periphery thereof similar to movable plate 244. Ears 296 and 298 include pin apertures which fixedly receive limit pins 246 and 248. The head plate holds limit pins 246 and 248 parallel to each other and parallel to connector rod 252. Body 294 of the head plate includes a nut recess 300 for receiving nut 288 which connects the connector rod to the movable plate. A bracket 302 with an opening 304 is fixed to head plate 250 to provide a means for securing the head plate and the fixed plate may be secured to frame 222 by other conventional means.

A bellows connector 306 connects bellows 240 to bellows 242 and a bellows connector 308 connects the bellows 238 to bellows 240. The construction of each of the resilient pneumatic bellows is identical. Bellows 238 includes a lower bead 310 which is mounted in a fixed annular bead plate 312. Bellows 238 has a pair of girdle hoops 314 and 316 to retain the bellows. The upper end of bellows 238 includes an upper bead 318 which is sealingly mounted in bellows connector 308. Bellows 240 includes a lower bead 320 which is sealingly mounted in bellows connector 308.

Figures 10, 11, 12, 13:
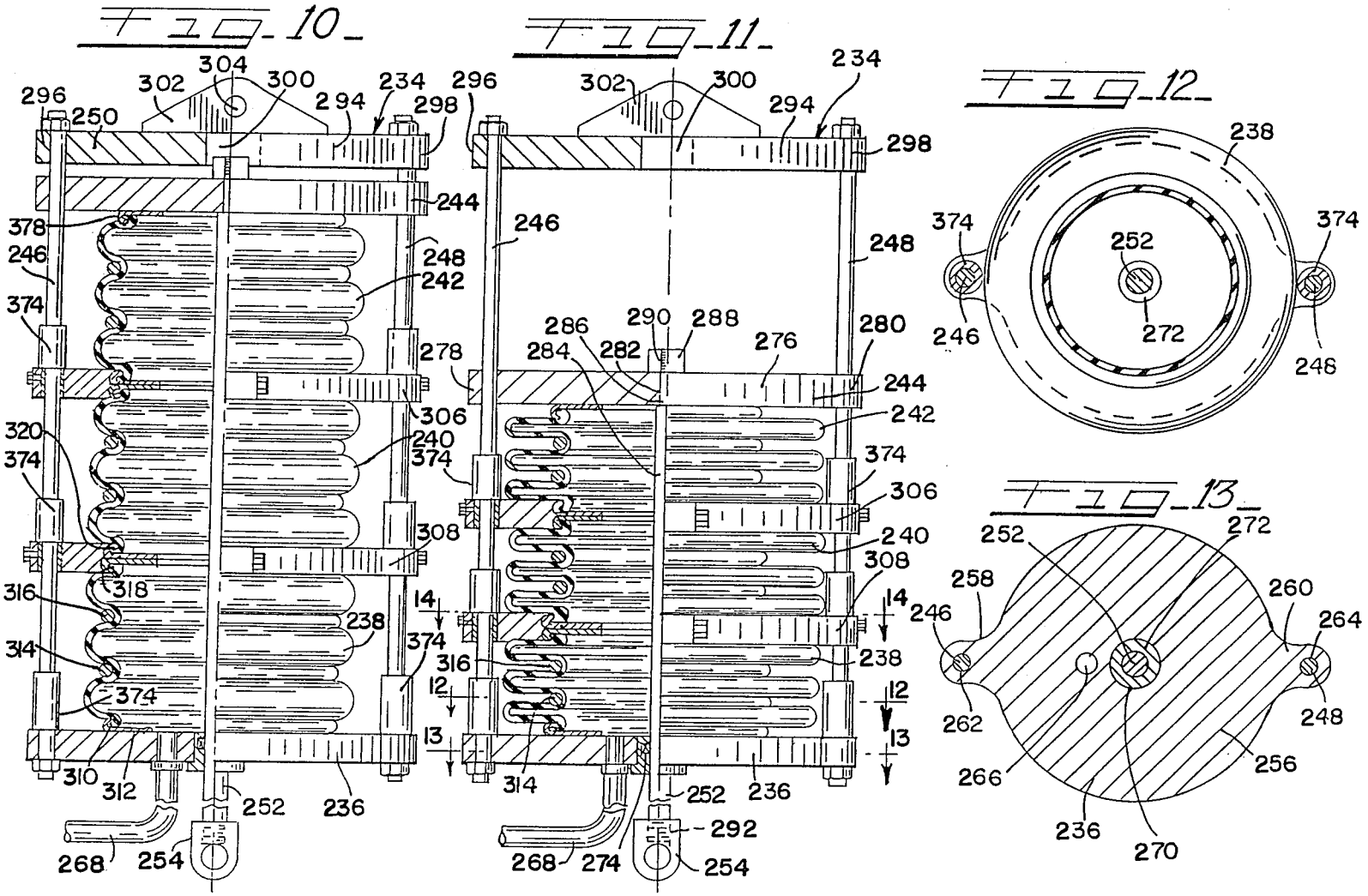
FIG. 10 is a side elevational view of one of the counterbalances shown in FIG. 1, but with a portion broken away in order to show the interior construction thereof, and the counterbalance shown in an expanded attitude.
FIG. 11 is a side elevational view similar to FIG. 10, but showing the pneumatic counterbalance in a substantially compressed attitude.
FIG. 12 is a cross sectional view taken on Line 12—12 of FIG. 11.
FIG. 13 is a cross sectional view taken on Line 13—13 of FIG. 11.
Figure 14:
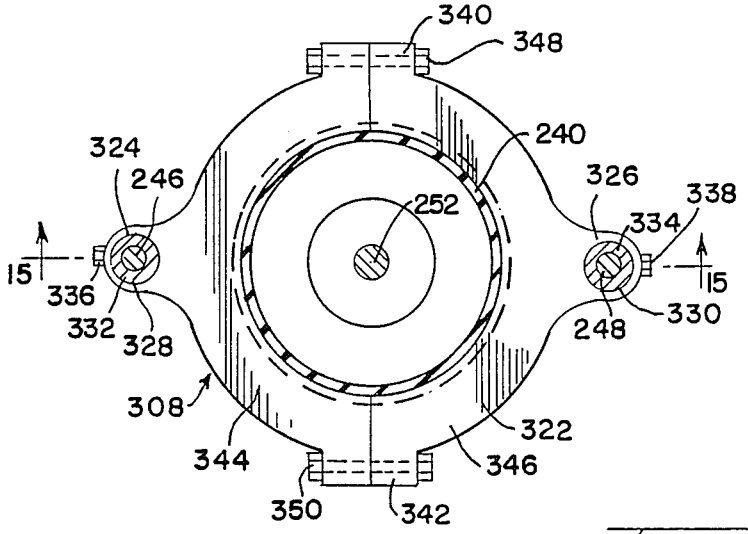
FIG. 14 is an enlarged cross sectional view taken on Line 14—14 of FIG. 11.
Figure 15:
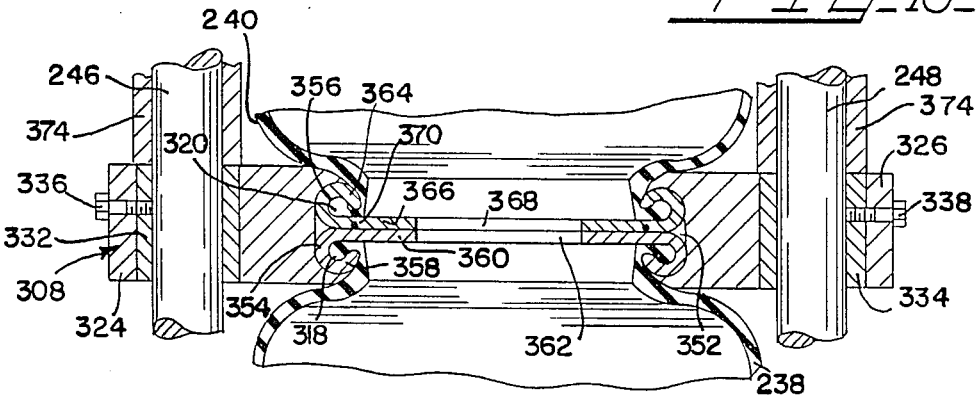
FIG. 15 is an enlarged cross sectional view taken on Line 15—15 of FIG. 14.
Figure 16:
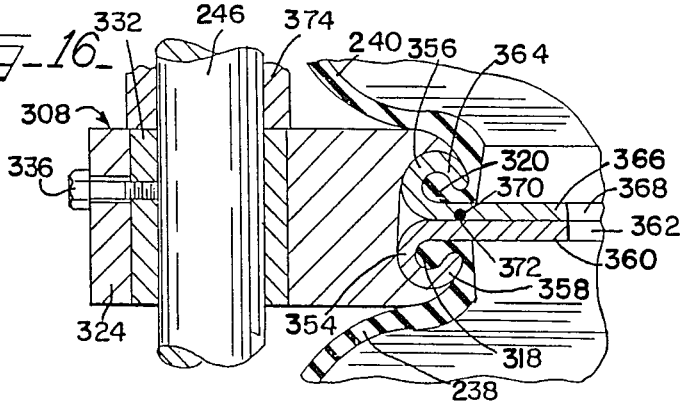
FIG. 16 is an enlarged fragmentary view of a portion of the counterbalance shown in FIG. 15.
Figure 17:
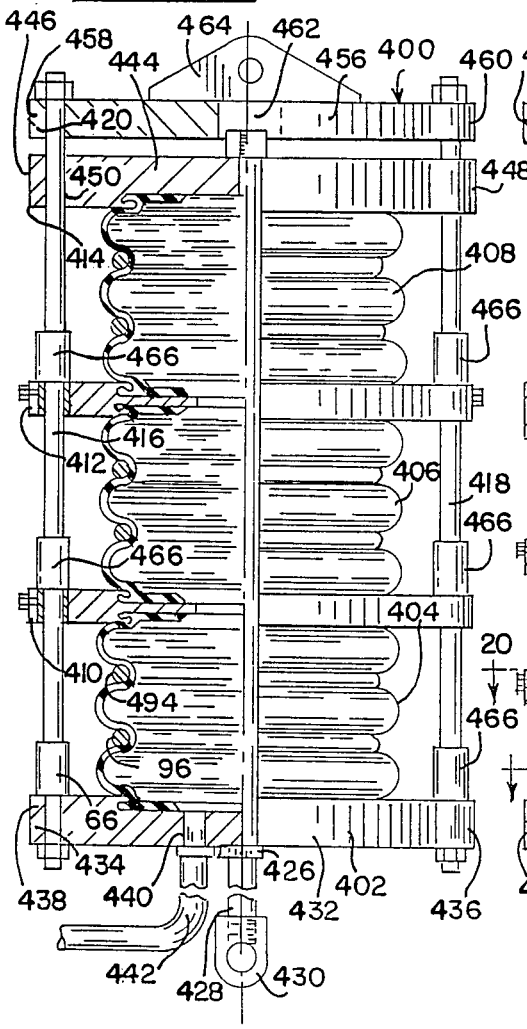
FIG. 17 is a side elevational view of a second form of the pneumatic counterbalance disclosed herein with a portion of the counterbalance broken away in order to show the interior construction of the counterbalance, and the counterbalance shown in an expanded attitude.
Figure 18:
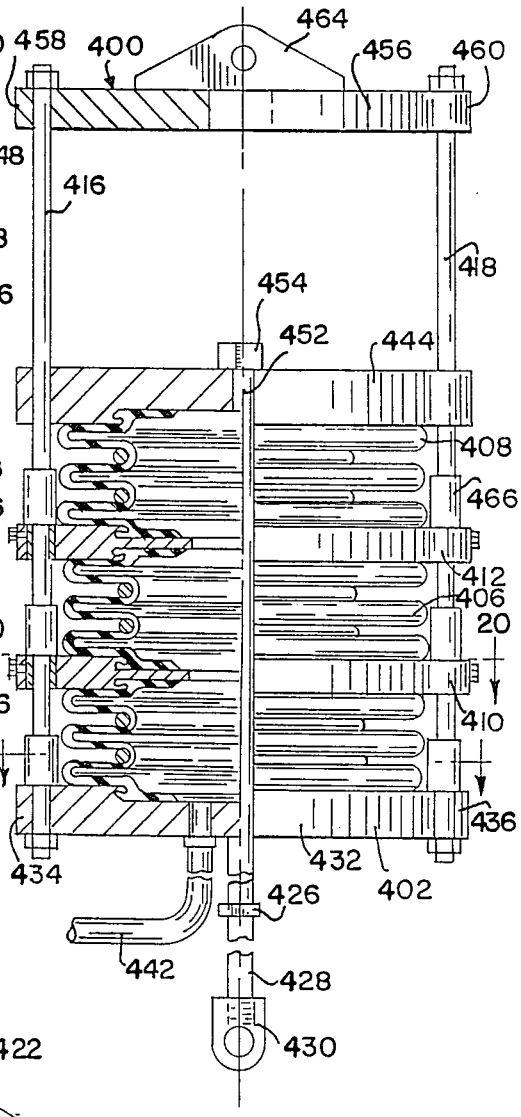
FIG. 18 is a side elevational view similar to FIG. 17, but showing the pneumatic counterbalance of FIG. 17 in a partially compressed attitude.
Figure 19:
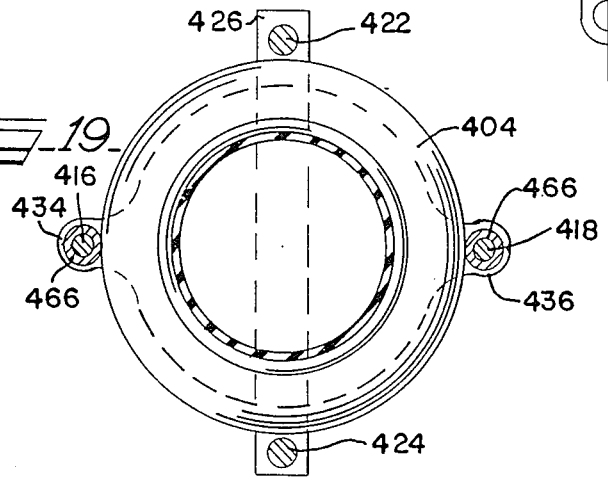
FIG. 19 is a cross sectional view taken on Line 19—19 of FIG. 18.
Figure 20:
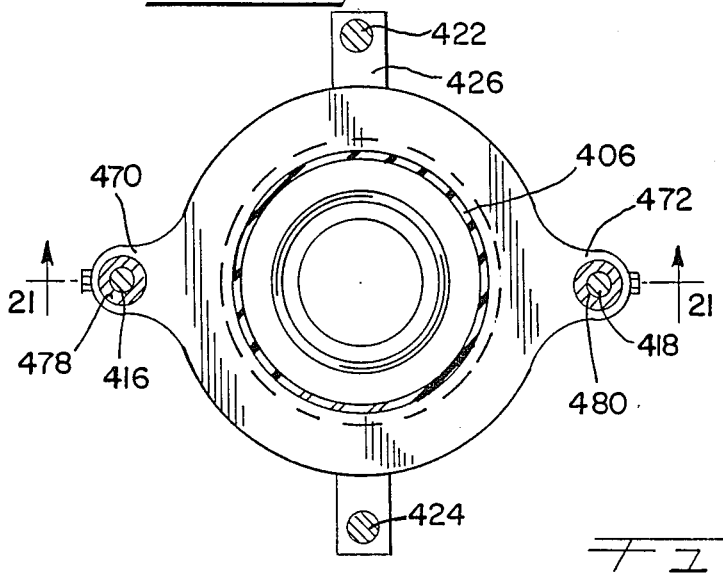
FIG. 20 is a cross sectional view taken on Line 20—20 of FIG. 18.

Bellows connectors 306 and 308 are identical in construction. The construction of bellows connector 308 is shown in FIGS. 10, 15 and 16. Bellows connector 308 includes a generally flat ring body 322 with a pair of guide ears 324 and 326 formed integral with the outer periphery of the ring body. Guide apertures 328 and 330 are formed in guide ears 324 and 326, respectively. Guide bushings 332 and 334 are mounted in guide apertures 328 and 330, respectively. Guide bushings 332 and 334 are held in position by machine screws 336 and 338 which extend through one side of the bushings. Bushings 332 and 334 slideably receive limit pins 246 and 248, respectively. Fastener shoulders 340 and 342 are formed integral with the outer periphery of ring body 322. The fastener shoulders are diametrically opposed from each other and are spaced 90 degrees from guide ears 324 and 326. The ring body is split diametrically forming two identical body halves 344 and 346. The split extends through the center of the fastener shoulders. Conventional fasteners 348 and 350 are mounted in fastener shoulders 340 and 342 to hold the halves together. The ring body includes an internal seal 352.

Two annular bead plates 354 and 356 are mounted in internal seal 352. Bead plate 354 includes an annular bead receptacle 358 with an annular sealing plate 360 formed integral. An opening 362 is formed in the center of annular sealing plate 360. Bellows 238 has its upper bead 318 mounted in bead receptacle 358 and is sealingly positioned therein.

Annular bead plate 356 includes a bead receptacle 364 with an annular sealing plate 366 formed integral therewith. An opening 368 is formed in the center of the annular sealing plate 366, and opening 368 is aligned with opening 362. Bellows 240 has its lower bead 320 sealingly mounted in bead receptacle 364.

Annular sealing plate 366 includes an O-ring groove 370 with an O-ring 372 mounted therein. The O-ring is in sealing engagement with annular sealing plate 360 so that there is a seal between annular sealing plate 360 and annular sealing plate 366. Thus, the bellows connector provides a sealing connection between adjacent bellows 238 and 240.

Turning now to FIGS. 10 and 11, it may be seen that three identical limiters 374 are mounted on each of the limiter pins 246 and 248. Each of the limiters is sleeve-like and is in slideable engagement with its respective limit pins. Two of the limiters are positioned between the fixed plate and bellows connector 308. Two limiters are positioned between the bellows connectors 306 and 308, and the remaining two limiters are positioned between bellows connector 306 and movable plate 244. The limiters maintain the space between the plates and the connectors so that should there be a complete loss of air or collapse of the bellows for any reason, movable plate 244 would not crush the bellows.

Press 10 operated conventionally in that motor 230 turns shaft 228 which forces ram 226 downward. As the ram moves downward, an upper die portion 375 approaches a lower die portion 376 which lower die portion is mounted on bed 224. The air contained in counterbalance 234 is compressed as the ram pulls control rod 252 downward thereby moving the movable plate 244 downward toward the fixed plate. Upon completion of the downward stroke of ram 226, the continued rotation of the shaft starts to raise ram 226. The compressed air in the bellows of the counterbalance pulls the ram upward and holds the connection between the ram and the shaft to be the same relative connection as when the ram is moving downward, so that there is a like relative engagement between the parts of the press when the ram is moving in a power stroke, as well as in the return stroke. A minimum selected air pressure is maintained in the bellows by a conventional source of compressed air through a conventional regulator, neither of which are shown herein. In the event that there is any leakage of air from either counterbalance, the leaked air is replenished from the source of compressed air.

The utilization of three bellows in each of the counterbalances allows each counterbalance to have a long stroke. The specific construction of the counterbalance allows the bellows of the counterbalances to be quickly and easily mounted. In the event that there is a necessity to replace a bellows, it is a simple task to release the two pins and remove the movable plate and then a bellows connector. The specific construction of each bellows at each of the opposite open ends of the bellows, allows the bellows to be quickly and easily removed and a new bellows quickly and easily placed in its stead. A bellows is simply removed from a bellows connector by releasing the two fasteners 348 and 350, thereby allowing the ring to be split and allow removal of the bellows with the annular bead plate. In order to replace a bellows, such as, bellows 240, bellows 240 is removed and another bellows with annular bead plates mounted on its end is placed in the internal seal. The two fasteners 348 and 350 are reinserted, and the connector is clamped back onto the bellows to hold the bellows in place.

It may be seen how an increase in pressure within the bellows tends to force the bellows outward and thereby improve the seal between the end of the bellows and the bead receptacle. The lower end of bellows 238 is mounted in a bead receptacle, of annular bead plate 312, which plate 312 is in turn sealingly connected to the fixed plate. The upper end of bellows 242 is sealingly connected in an annular bead plate 378 identical to bead plate 312, which plate 378 is sealingly connected to movable plate 244.

It may be appreciated that should any wear occur between bushings 332 and 334 and their respective limit pins, the bushings may be easily replaced to maintain a close alignment with the connector rod.

Although a specific construction of counterbalance 234 has been described in detail above, another form of counterbalance may be utilized instead of counterbalance 234. The other form of counterbalance is identified as counter balances 400 and is shown in FIGS. 17 through 22.

Counterbalance 400 includes a fixed plate 402 which is fixedly connected to the frame 222 of the power press. Three resilient pneumatic bellows 404, 406 and 408 are supported on fixed plate 402. A bellows connector 410 connects one end of bellows 404 to one end of bellows 406. An identical second bellows connector 412 connects the other end of bellows 406 with bellows 408. A movable plate 414 is connected to the upper end of bellows 408. A pair of pins 416 and 418 is connected to fixed plate 402. A head plate 420 is fixed to the pins 416 and 418. Identical connector rods 422 and 424 are fixed to movable plate 414 at one end and at the other end the connector rods are connected to a cross beam 426. The crossbeam has an extension connector rod 428 fixed to the center of the crossbeam and a mounting ear 430 is threadedly mounted on the end of the extension rod for connection to the ram of the power press.

Fixed plate 402 generally includes a circular body 432 with a pair of ears 434 and 436 formed integral with the outer periphery of the circular body. Each of the ears includes a pin aperture 438 to receive a respective limit pin. The fixed plate includes an air inlet aperture 440 with an air inlet pipe 442 mounted therein. The air inlet pipe is connected to a conventional source of compressed air through a conventional regulatory valve, neither of which is shown herein.

Movable plate 414 includes a flat circular body 444 having a pair of ears 446 and 448 formed integral with the outer periphery of body 444. The ears include pin apertures 250 which slideably receive limit pins 416 and 418. Movable plate 414 includes a pair of connector rod ears 452 which are identical to each other and are diametrically opposed from each other. The connector rod ears contain apertures and each receives connector rods 422 and 424, respectively. Identical nuts 454 are threaded on connector rods 422 and 424, respectively.

Head plate 420 includes a flat circular head plate body 456 with a pair of ears 458 and 460 formed integral with the outer periphery of the body. The head plate body includes a pair of nut apertures 462 to receive nut 454 attached to the connector rods. A bracket 464 is fixed to the head plate body.

Three identical sleeve-like limiters 466 are slideably mounted on each of the limiter pins 416 and 418. A limiter mounted on each of the limit pins is positioned between the fixed plate and bellows connector 410. A limiter mounted on each of the limit pins is positioned between the two bellows connectors and a limiter mounted on each of the limit pins is positioned between bellows connector 412 and the movable plate.

Figure 21:
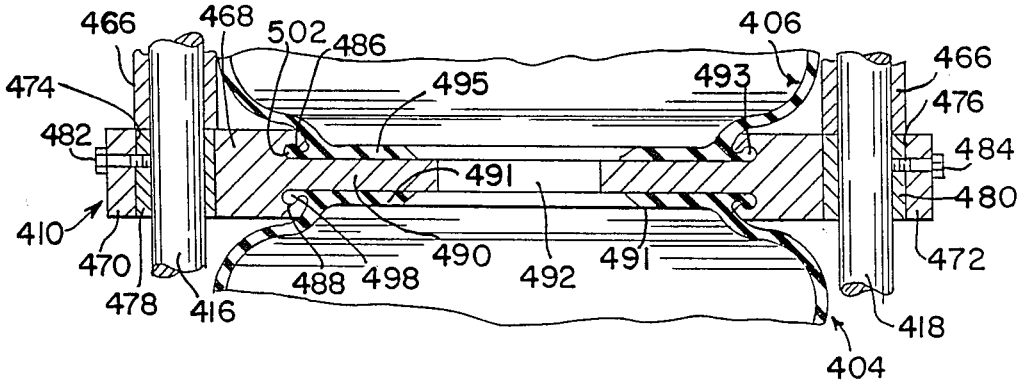
FIG. 21 is an enlarged fragmentary cross sectional view taken on Line 21—21 of FIG. 20.
Figure 22:
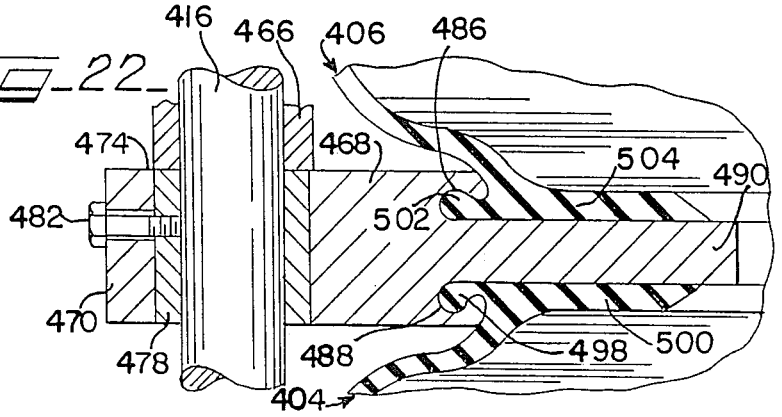
FIG. 22 is an enlarged fragmentary portion of the counterbalance shown in FIG. 21.

The specific construction of bellows connector 410 is shown in FIGS. 21 and 22. Bellows connector 410 includes a ring body 468 having a pair of pin ears 470 and 472 formed integral with the outer periphery of the ring body. Pin aperture 474 is formed in ear 470 and a like pin aperture 476 is formed in ear 472. Bushings 478 and 480 are positioned in apertures 474 and 476, respectively. Machine screws 482 and 484 hold the bushings 478 and 480, respectively, in place. Limit pins 416 and 418 are slideably mounted in bushings 478 and 480, respectively.

Ring body 468 includes an internal seal, which internal seal includes an upper annular bead groove 486 and a lower annular bead groove 488. An annular disk 490 is formed integral with the interior of the ring body and is positioned between bead grooves 486 and 488. The annular disk includes an opening 492 in its center.

Bellows 404 which is identical to bellows 406 and 408 has opposed open ends and a pair of girdle hoops 494 and 496. As may be seen in FIGS. 21 and 22, bellows 404 has a bead 498 formed integral with its upper end, which bead is in sealing engagement with bead groove 488. The bellows also has an annular bellows lip 491 formed integral with the bead which is in sealing engagement with the underside of the annular disk. In like manner, bellows 406 has identical construction on its lower end in that it includes an annular bead 493 which is sealingly mounted in annular bead groove 486 and an annular lip 495 formed integral with the bead. Lip 495 is in sealing engagement with the upper side of annular disk 490.

The construction of the lower end of bellows 404 is identical to the construction of the lower end of bellows 406. Fixed plate 402 includes a groove arrangement identical to the groove arrangement of the bellows connector so that the bottom of the bellows 404 is sealingly mounted in the fixed plate. Movable plate 414 has a groove arrangement identical to the lower portion of bellows connector 410. Plate 414 sealingly receives the upper portion of bellows 408, which has a bead and a lip arrangement identical to the upper end of bellows 404.

The operation of pneumatic counterbalance 400 is substantially identical to the operation of pneumatic counterbalance 234 disclosed in detail above. However, counterbalance 400 does not have a connector rod extending through the interior of the counterbalance. Movement of the ram compresses the air in the bellows. The air is compressed and as the ram returns, the compressed air pulls the ram up. The utilization of the two connector rods exteriorly of the bellows eliminates the need for a seal between the connector rod and the fixed plate.

The specific construction of the bellows provides a double seal arrangement in that the bellow lip is in sealing engagement with the annular disk and the bead in the bead groove provides an additional seal. As the pressure increases within the bellows, the bellows is placed into firm engagement with the connector to provide an improved seal.

As was mentioned herein above, the bushings may be changed to accommodate for wear. The limiters prevent the bellows from being crushed.

Figure 23:
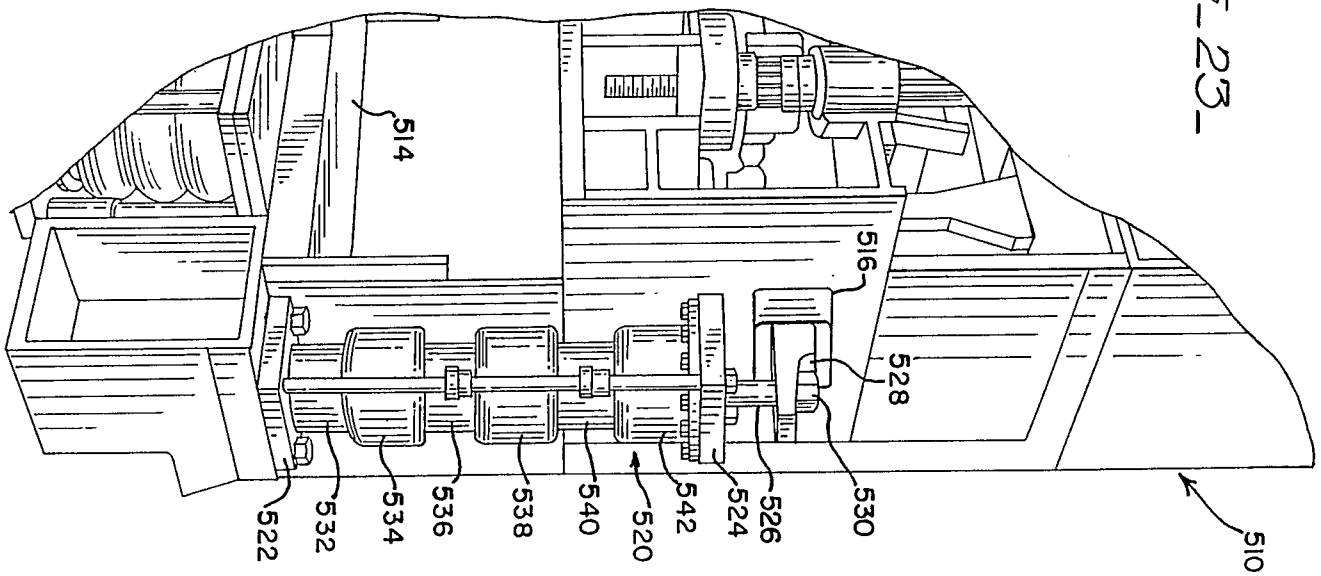
FIG. 23 is a front view of a portion of a press provided with an alternate form of counterbalance which is provided with resilient tubular bellows.

Referring now to FIG. 23, a pneumatic counterbalance 520, being a specific element of the present invention, is shown mounted on press 510. A like counterbalance is mounted on the other side of the press and is not shown herein.

Counterbalance 520 generally includes a fixed plate 522 which is secured to the frame and a movable plate 524 which is fixedly connected to ram 516 through a column 526 which is secured to a hanger 528 by a nut 530. The counterbalance also includes a base tube 532 fixed to plate 522. A lower bellows 534 has its lower end sealingly connected to tube 532. A first connector 536 is sealingly connected to the upper end of the lower bellows. An intermediate bellows 538, identical in construction to bellows 534, has its lower end sealingly connected to connector 536, is sealingly connected to the upper end of intermediate bellows 538. An upper bellows 542 has its lower end sealingly connected to connector 540. Upper bellows 542 has its upper end sealingly connected to movable plate 524.

Figures 24, 25, 26:
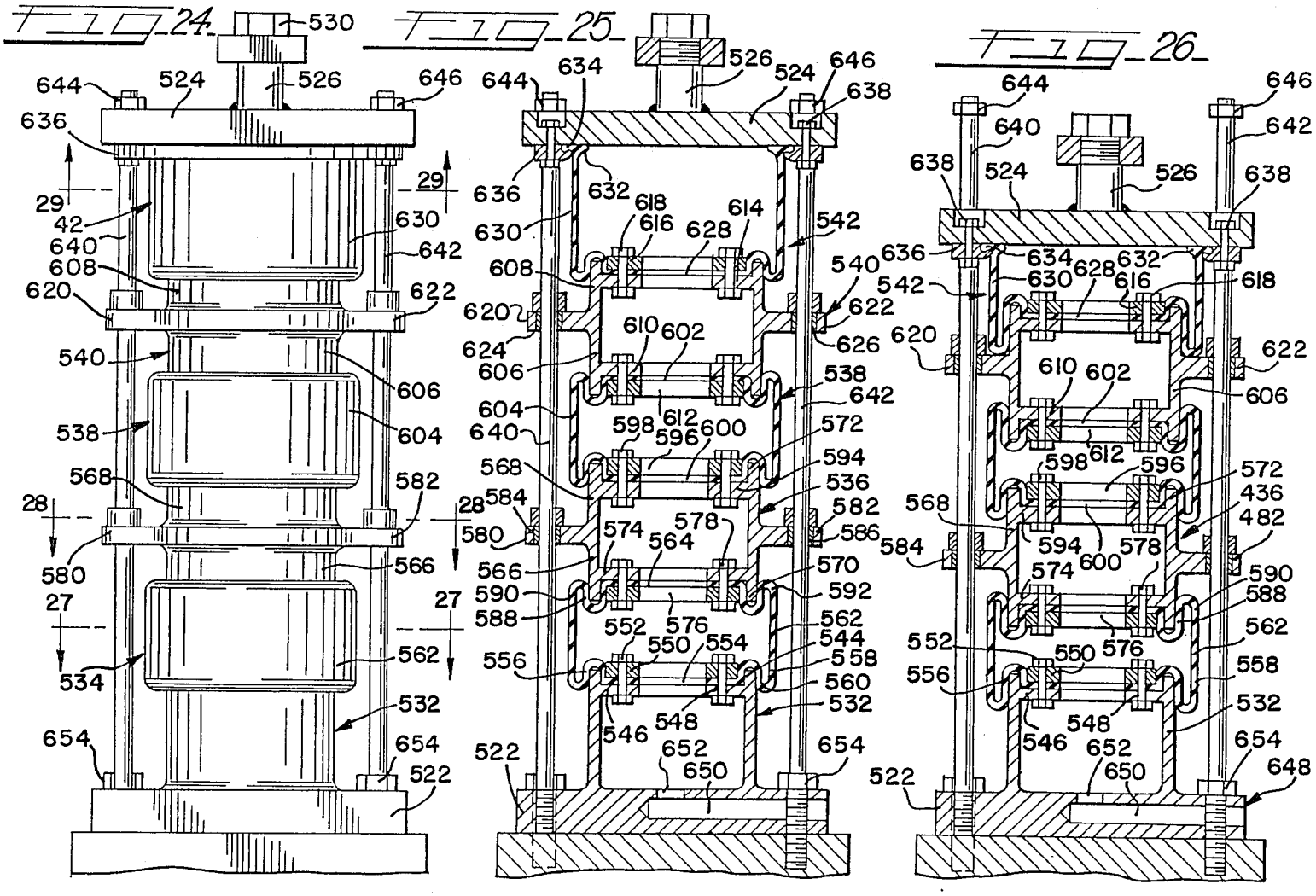
FIG. 24 is an enlarged side elevational view of the counterbalance shown in FIG. 23.
FIG. 25 is a cross sectional view of the counterbalance shown in FIG. 24 in its fully extended attitude.
FIG. 26 is a cross sectional view similar to FIG. 25 but showing the counterbalance in a partially compressed position.
Figure 27:
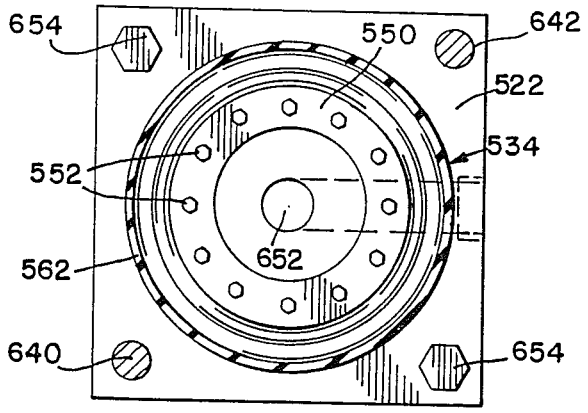
FIG. 27 is a cross sectional view taken on Line 27—27 of FIG. 24.
Figure 28:
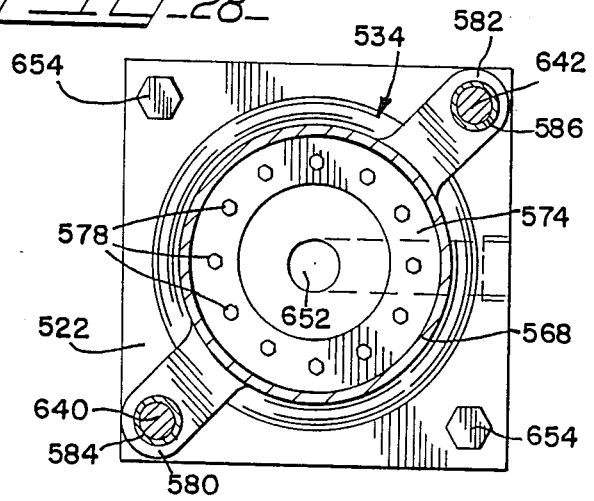
FIG. 28 is a cross sectional view taken on Line 28—28 of FIG. 24.
Figure 29:
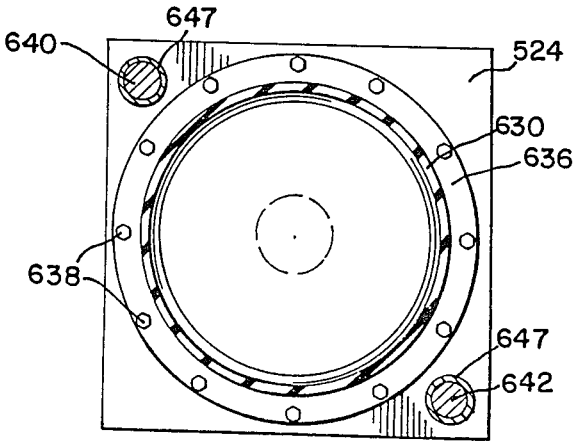
FIG. 29 is a cross sectional view taken on Line 29—29 of FIG. 24.

Referring now to FIGS. 24, 25 and 26, base tube 532 has one end formed integral with fixed plate 522 and the opposite end is free end 544. Base tube 532 is a right circular cylinder wherein the tube has a center axis which is perpendicular to fixed plate 522. An internal annular sealing ledge 546 is formed integral with the interior of tube 532 adjacent to free end 544. The sealing ledge has a plurality of bolt holes 548 formed therein for receiving a bolt in each of the holes. A mating clamp ring 550 is connected to sealing ledge 546 by a plurality of identical bolts 552.

Lower bellows 534, which is an integral resilient member, has an open end 554 which is sealingly secured to sealing ledge 546 by clamp ring 550. The lower bellows has a first portion 556 which is connected to the open end 554 and surrounds a portion of the free end of base tube 532. Bellows 534 has a second portion 558 which is formed integral with the first portion and is connected by a fold 560. Second portion 558 surrounds first portion 556. The second portion 558 is part of a resilient tubular sleeve 562 which has another open end 564 at the opposite end of the sleeve.

Connector 536 includes a pair of identical opposed connector tubes 566 and 568 which are formed integral with each other and extend opposite to each other. Connector tube 566 includes a free end 570, and connector tube 568 includes a free end 572. Tube 566 has an internal annular sealing ledge 574 formed integral with the interior wall of the tube adjacent to free end 570. A clamp ring 576 is secured to sealing ledge 574 by a plurality of conventional bolts 578. The tubes 566 and 568 are both right circular cylinders so that an opening extends through connector 536. The first connector includes a pair of ears 80 and 82 formed integral with tubes 566 and 568. Bushings 584 and 586 are mounted in ears 580 and 582, respectively.

The other open end 564 of bellows 534 is sealingly secured to sealing ledge 574 by clamp ring 576. Bellows 534 includes a third portion 588 which surrounds a portion of the freed end of tube 566 and is connected to a fourth portion 590 by a fold 592. The fourth portion 590 surrounds third portion 588. Fourth portion 590 is formed integral with the second portion 558. Tube 568 includes an internal annular sealing ledge 594 and a clamp ring 596 is secured to ledge 594 by a plurality of conventional bolts 598.

Intermediate integral resilient bellows 538 is constructed identically to lower bellows 534. Bellows 538 includes an open end 500 which is sealingly connected to sealing ledge 594 by clamp ring 598. The interconnection of the bellows with sealing ledge 594 is identical to that described in relation to the connection of open end 554 of lower bellows 534 with base tube 532. Bellows 538 has an open end 602 which is connected by a resilient tubular sleeve 604 to open end 600.

Connector 540 is identical in construction to connector 536. Connector 540 has a pair of opposed right circular cylindrical connector tubes 606 and 608 which extend away from each other. An internal annular sealing ledge 610 is formed integral with the interior of tube 606 and a clamp ring 612 sealingly connects open end 602 to tube 606. Tube 608 includes an internal annular sealing ledge 614 which has a clamp ring 616 secured thereto by a plurality of bolts 618. Ears 620 and 622 are formed integral with tubes 606 and 608, respectively. Bushings 624 and 626 are mounted in ears 620 and 622, respectively.

Upper integral resilient bellows 542 has an open end 628 which is sealingly connected to sealing ledge 614 by clamp ring 616. The open end 628 is connected to a resilient tubular sleeve 630. The connection between tubular sleeve 630 and open end 628 is identical to the interconnection of tubular sleeve 562 with open end 554 described in detail above. The tubular sleeve 630 has an upper open end 632 which includes an annular lip 634. An upper clamp ring 636 engages the lip 634, and a plurality of bolts 638 secure clamp ring 636 to movable plate 524 to form a seal between the open end 632 and the movable plate. Column 526 is fixed to movable plate 524.

A pair of guide rods 640 and 642 are parallel to each other. Each of the guide rods is threadedly mounted in fixed plate 522. Stop nuts 644 and 646 are threadedly mounted on the upper end of guide rods 640 and 642, respectively. Connector 540 has its bushings 624 and 626 slideably mounted on the guide rods 640 and 642, respectively. Movable plate 524 also has bushings 647, which bushings slideably engage guide rods 640 and 642 so that the movable plate and two connectors move in substantially a straight line relative to the fixed plate since they are restrained by guide rods 640 and 642 to such a motion.

Fixed plate 522 includes an air inlet 648 which allows air to enter the interior of tube 532. The air inlet includes a radial passage 650 which connects with an axial passage 652. The axial passage opens into the interior of tube 532. The radial passage 650 is connected to a conventional source of air under pressure through a conventional and well known regulator valve to keep the pressure of the air within the three bellows at a selected uniform pressure.

The fixed plate is secured to the frame of the press by a pair of machine screws 644.

In operation, when ram 516 is moved downward toward bed 514, the movable plate 524 is pushed toward fixed plate 522. As the movable plate is moved downward, the upper bellows has a greater portion of its portion surrounding the tube 508 moved downward through the fold which moves downward. As may be seen in FIG. 26, each of the bellows has a greater portion of the tubular sleeves moved into an attitude surrounding the respective tubes. The air contained in the bellows and in the connectors is compressed. All of the bellows are interconnected through the connectors so that there is a substantially uniform pressure in the bellows. Once ram 516 reaches the bottom of its stroke and starts its return motion, the air compressed in the balance pushes upward against the ram so that selected parts are held in the same relative engagement on the return stroke, as well as on the power stroke.

It may be appreciated that though three bellows have been shown herein, a balance may be build having less bellows or more bellows simply by the removal of connectors or the addition of connectors. In view of the fact that there is a fixed seal between the bellows and the other parts, it is readily apparent that the likelihood of any leaks occurring is greatly diminished, thereby conserving air.

Figure 30:
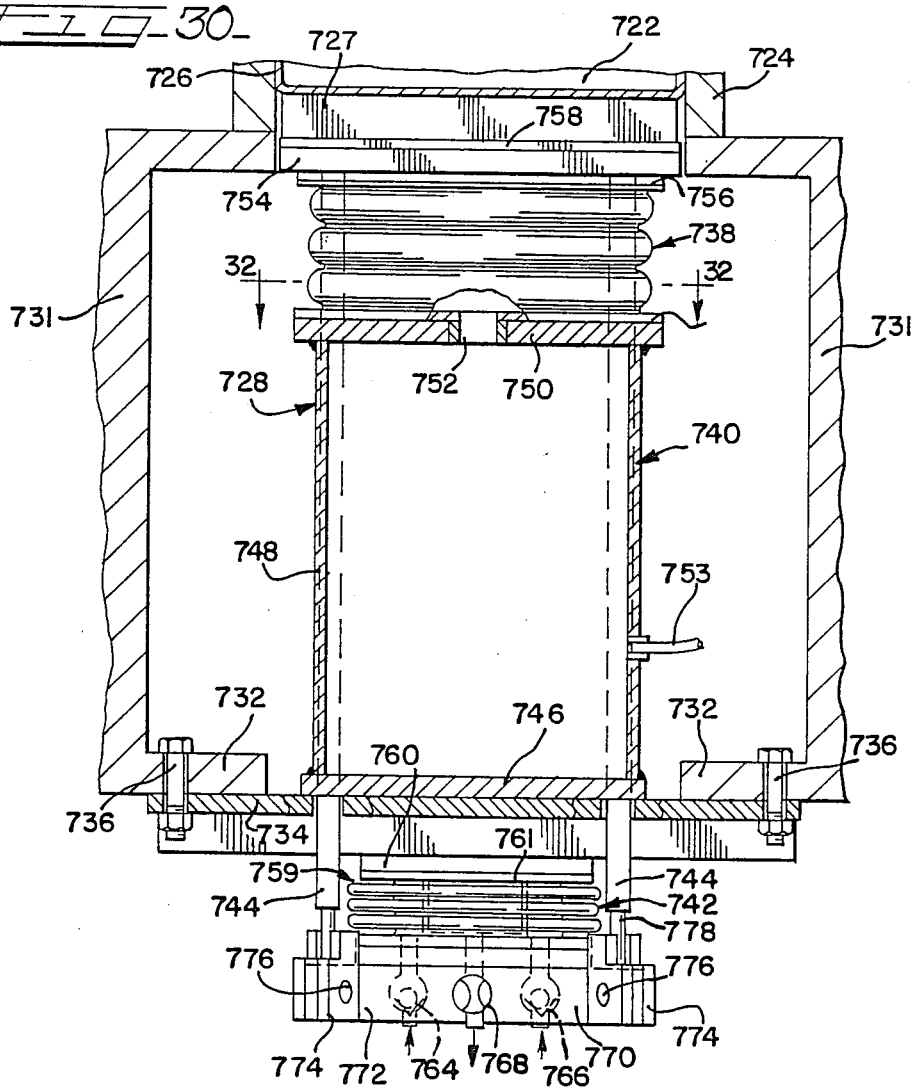
FIG. 30 is an enlarged partial cross sectional view of a die cushion incorporating a resilient snubber actuator.
Figure 32:
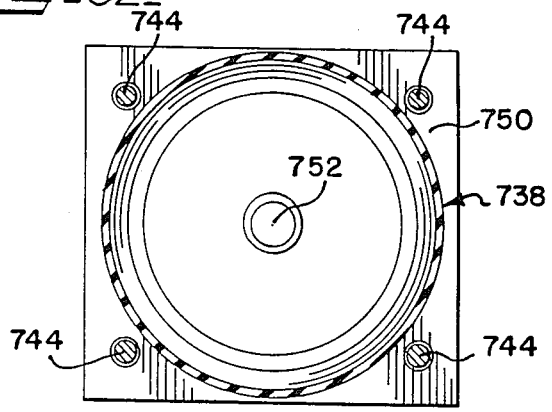
FIG. 32 is a cross sectional view taken on Line 32—32 of FIG. 30.
Figure 31:
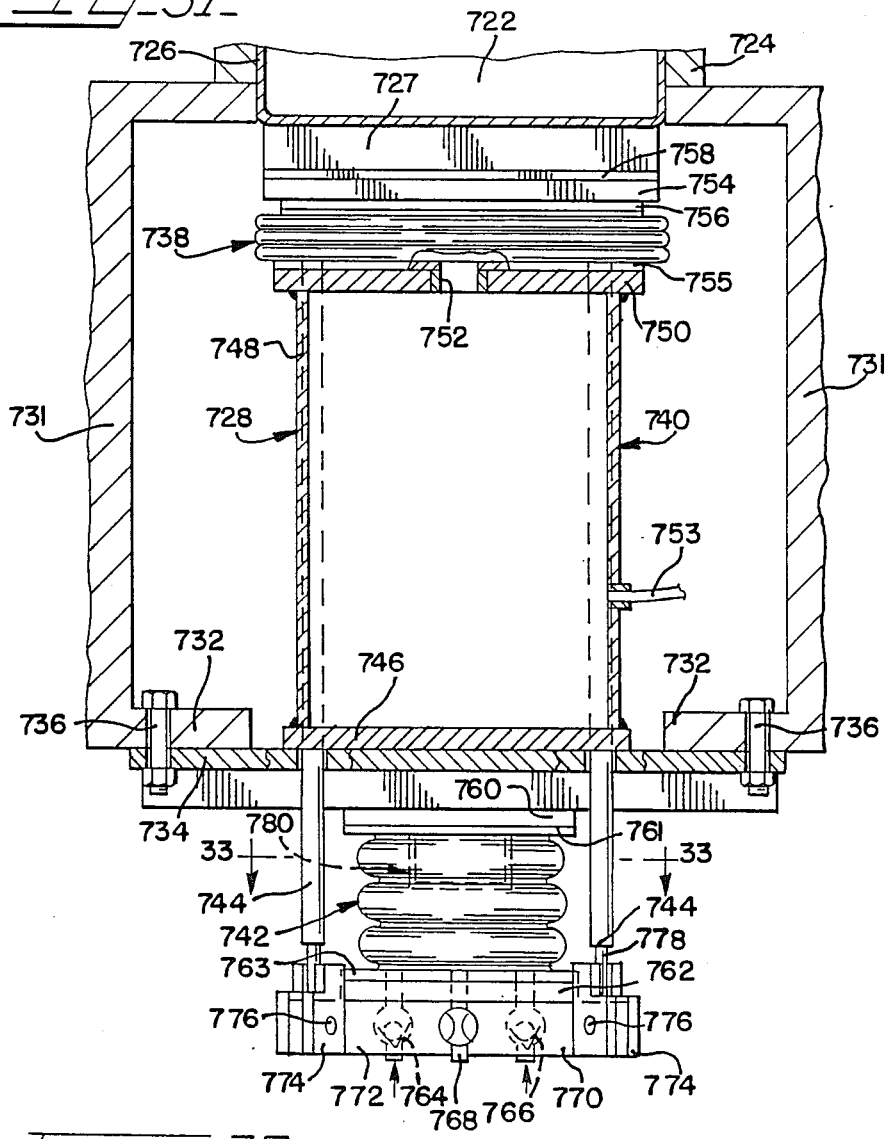
FIG. 31 is a cross sectional view similar to FIG. 30 but showing a cushion actuator in a substantially comprised state and a snubber actuator in a substantially extended attitude.
Figure 33:
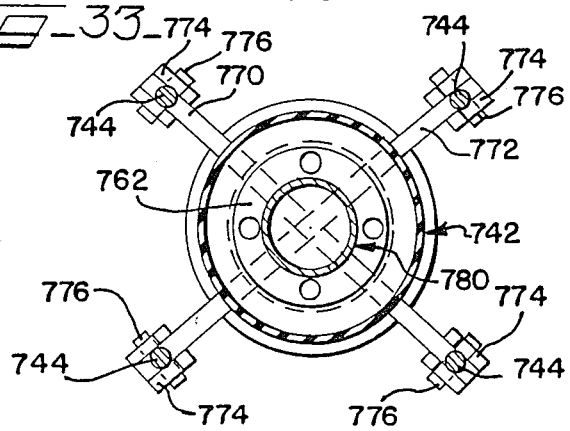
FIG. 33 is a cross sectional view taken on Line 33—33 of FIG. 31.
Figure 34:
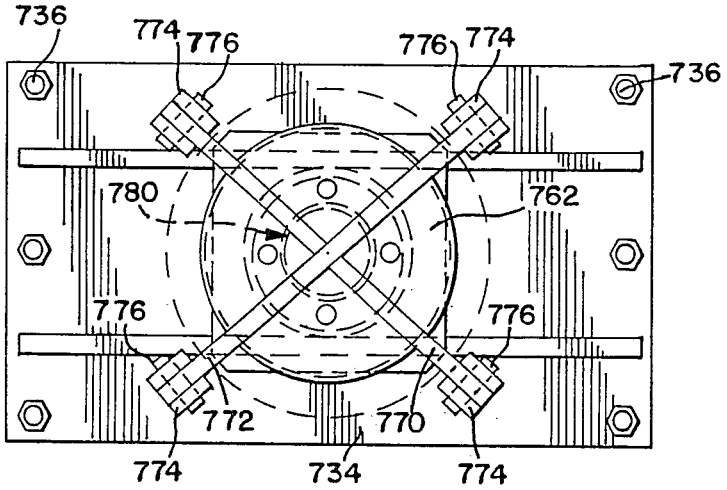
FIG. 34 is a bottom view of the die cushion of FIG. 30.
Figure 35:
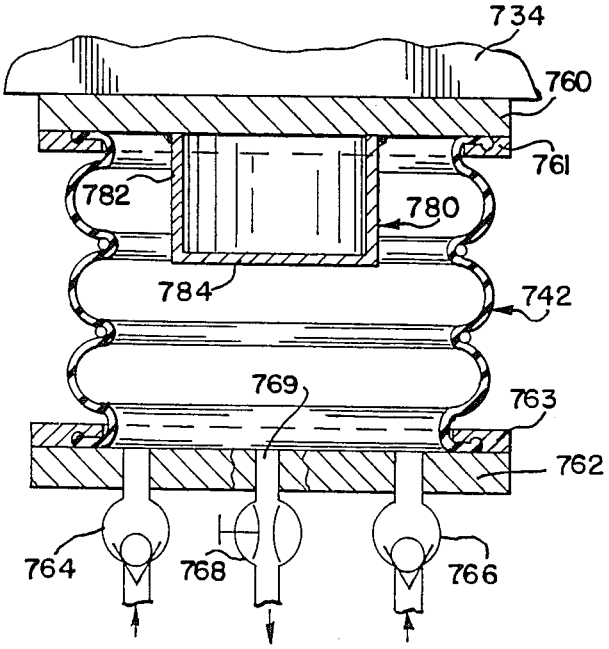
FIG. 35 is an enlarged cross sectional view of a snubber actuator showing a stop mounted within the snubber actuator.

Referring now to FIGS. 30 and 31, it may be seen that a metal blank or workpiece 726 is mounted in die 720 with the movable portion 722 positioned in a downward attitude in engagement with the blank or workpiece, to form the workpiece as viewed in FIGS. 30 and 31. The lower portion of the die includes an ejector 727, which moves a selected distance with the workpiece and the movable portion of the die as is conventional.

Die cushions 728 and 730 are connected to ejector portion 727. Each of the die cushions 728 and 730 is a specific embodiment of the herein disclosed invention. The specific construction of die cushion 728 is described hereinafter. It being understood that the construction of die cushion 730 is identical to the construction of die cushion 728.

The base of the power press includes a pair of side walls 731 which are shown in FIG. 30, since they have been broken away in order to show better the installation of the subject die cushions. A mounting flange 732 is formed integral with side walls 731. A support beam 734 is secured to the mounting flange 732 by a plurality of conventional bolts 736. Die cushion 728 is mounted on support beam 734.

Die cushion 728 generally includes a conventional resilient bellows type cushion actuator 738 which is connected to ejector portion 727 of the die. A surge tank 740 is connected to cushion actuator 738. The surge tank supports actuator 738. The surge tank is mounted on support beam 734. A snubber actuator 742 which is a resilient bellows type actuator has one end fixed to the support beam and the other end is connected to a movable portion of actuator 738 through a plurality of identical limiter rods 744.

The surge tank is conventional in its construction in that it includes an end plate 746 which is fixed to support beam 734. Surge tank 740 includes a cylindrical side wall 748 which has one end welded to end plate 746. A fixed plate or port plate 750 is welded to the other end of cylindrical wall 748. Port plate 750 includes a port 752 to receive air from actuator 738. The surge tank is connected to a conventional and well known source of compressed air through a conventional conduit 753 in order to supply compressed air to the surge tank and actuator 738.

As was mentioned above, actuator 738 is a conventional resilient bellows type actuator which has one end sealingly fixed to fixed plate or port plate 750 by a conventional sealing plate 755. A movable plate or mounting plate 754 is sealingly connected to the other end of the actuator by a sealing connector plate 756 as is conventional. A striker plate 758 is secured to mounting plate 754 in a customary manner by conventional fasteners, which are not shown herein. Ejector portion 727 is secured to striker plate 758 as is conventional.

A snubber assembly 759 is mounted below the support beam and is connected to movable plate 754 by means of the rods 744. The snubber assembly includes a head plate 760 fixed to the support beam 734, and, in turn to fixed plate 750 through the surge tank. The snubber actuator which is part of the snubber assembly has one end sealingly fixed to head plate 760 by a snubber head sealing plate 761. Snubber actuator 742 has its other end sealingly connected to a movable snubber port plate 762 by a lower sealing plate 763. The snubber port plate 762 has a pair of one-way valves 764 and 766 mounted thereon. The one-way valves 764 and 766 communicate with the interior of the snubber actuator 664 so that as snubber actuator 742 is expanded, air is drawn into the interior of the actuator through the one-way valves. A variable rate valve 768 is also mounted in the snubber port plate 762 and communicates with the interior of snubber actuator 742 through a port 769.

The snubber port plate 762 is mounted on a pair of intersecting support bars 770 and 772. A clevis 774 is mounted on the end of each of the support bars 770 and 772. Each of the limiter rods 744 is connected to each clevis 774 by a pivot pin 776. Each of the rods 744 has a conventional threaded interconnector end portion 778 which allows the length of each of the rods to be adjusted. By appropriate adjustment of the length of rods 744, the snubber port plate 762 may be positioned parallel to movable plate 754 so that parallel positioning of upper and lower mechanisms are maintained. Each of the rods 744 has its other end fixed to the movable plate 754 so that the free end of the snubber actuator moves with the movable plate.

The snubber assembly includes a stop 780 mounted on head plate 760 inside of snubber actuator 742. The stop includes a cylindrical side wall 782 with a stop plate 784 formed integral with the side wall. The cylindrical side wall is sealingly welded to head plate 760 so that air may not enter or leave the interior of stop 780. The stop provides a means for limiting movement of port plate 762 toward head plate 760 and, thereby, movement of movable plate 754 away from the snubber assembly.

The instant die cushions 728 and 730 are particularly effective for use in a high speed power press. Typically, in a high speed power press, ram 716 moves up and down at a quick rate. With the use of the subject die cushions, the impact loading on the lower portion of the die is substantially reduced. Ram 716 moves upper portion 722 of the die downward to engage workpiece 626 and with it ejector portion 727 of the lower portion of the die. The downward movement of the ram pushes mounting plate 754 downward to compress the cushion actuator. The compression of the cushion actuator acts to compress the air within the cushion actuator and to force some of the air into the surge tank through port 752. The compression of the cushion actuator acts to compress the air within the cushion actuator and to force some of the air into the surge tank through port 752. The compression of the cushion actuator applies a resistant force to a tooling workpiece connected to the ram to allow the workpiece to be drawn as is conventional.

As the cushion actuator is compressed, the snubber assembly is also placed into operation. As mounting plate 754 moves toward the snubber assembly, limiter rods 744 moves snubber port plate 762 away from the snubber head plate and, thereby extend the snubber actuator. As the snubber actuator is extended, air is drawn into the snubber actuator through one-way valves 764 and 766 and through variable rate valve 768.

At the end of the ram's stroke, the ram is raised upward and raises with it upper portion 722 of the die. The ram is powered upward and moves quickly, whereas the ejector portion 727 of the die is moved by the compressed air contained in the cushion actuator and in the surge tank. The inertia of the parts causes portion 727 to move slower than the ram so that movable portion 722 disengages workpiece 726. The force of the compressed fluid in the cushion actuator tends to accelerate continuously the rate of movement of the movable plate away from the snubber. However, the air contained in the snubber actuator becomes compressed and provides a resistance to the acceleration of the movable plate away from the snubber. Thus, there is a restrained movement of the movable plate as the plate reaches its return position without a high impact loading on the lower portion of the die. The compressed air in the snubber actuator may not exit through the two one-way valves leaving only port 769 connected to variable rate valve 768 as the means for exit. The exiting of the air through the variable rate valve provides a control for the rate of movement of the mounting plate away from the snubber assembly to its original position. The rate of flow of fluid through valve 768 is adjustable to adjust the rate of return of the ejector position, to adjust the snubbing of the cushion for various speeds of operation. Stop 780, built into the snubber, acts as a stop within the snubber actuator.

Stop 780 serves a dual function in that it serves as a mechanical stop at the end of the stroke of the snubber actuator. The second function which it serves is to provide a volume reducer for the snubber actuator at the end of the stroke. It may be appreciated that as the snubber port plate moves toward head plate 760, the volume within the actuator reduces; however, as the port plate approaches stop plate 784 of the stop, the amount of volume reduction within the snubber actuator increases at an ever-increasing rate, thereby causing a buildup of pressure within the actuator at a greater rate to increase the force restraining the cushion actuator. The restraint of the cushion actuator causes the mounting plate to come to a relatively smooth stop, thereby further protecting the die connected to the mounting plate from a high impact loading.

Although the instant die cushions have been shown with a surge tank, it is readily apparent that the cushion actuator may be used without a surge tank in certain applications.

Figure 36:
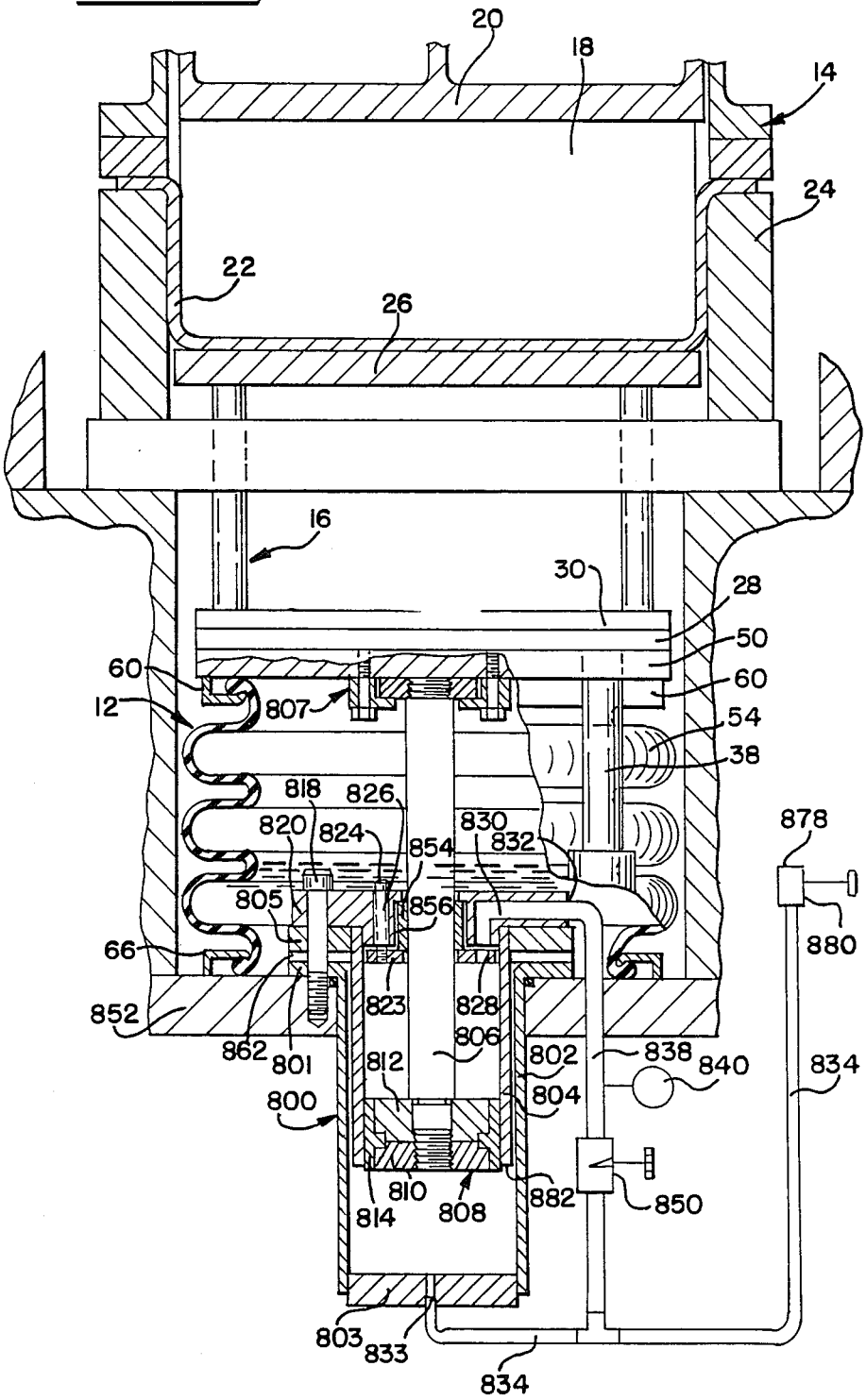
FIG. 36 is a partial cross sectional view of a die cushion incorporating a snubber and showing the cooperation of the cushion with a die.

FIG. 36 is a partial cross sectional view of a die cushion incorporating a hydraulic snubber actuator 800. The snubber comprises an outer cylinder 802 having a closure 803 at one end and an annular flange 801 extending outwardly at right angles at the other end. A second hollow cylinder 804 with annular flange 805 at one end is mounted within the first cylinder 802 with spacing between the two cylinders sufficient for the free flow of a liquid and with flange 805 mounted above and adjacent to flange 801 sealingly mounted on mounting plate 802. A cylindrical cover plate 820 having a concentric cylindrical portion extending on one side whose outer diameter is slightly smaller that the inside diameter of cylinder 804 is closely fitted inside the open end of cylinder 804. The two cylinders and cover plate are fastened at several points by bolts 818 passing through mating holes drilled in the flanges and cover plate and screwed into threaded holes in the mounting plate 852. Cover plate 820 has a hydraulic fluid hole 826 through its thickest portion providing a passageway between the inside of the bellows 12 and the upper portion of cylinder 804. An annular disc 823 is supported by several bolts 824 which can move freely up and down through holes drilled in the cover plate 820.

A piston rod 806 supporting piston assembly 808, consisting of piston ring 814, cylindrical body 812 and retaining nut 808, within the cylinder 804 below disc 823 is free to move in reciprocal fashion within the cylinder 804 and extends outwardly through a hole at the center of the cover plate. An enlarged portion of the hole at the center provides space 856 into which seal 854 closely fitted to the outer diameter of piston rod 806 is placed. The threaded end of the piston rod which is opposite the piston is attached by means of a swivel assembly 807 to the adapter plate 50 attached to the upper movable plate 28 of the cushion, so that when the moveable plate moves downward, the piston will move downward and vice-versa.

The coverplate is also provided with a control passage 830 which will allow fluid to pass during the upstroke of the piston, from the space inside of the cylinder which is above the piston through the passage 830 and through orifice 832, through the conduit 838 attached to the orifice, through pressure gauge 840 and metering valve 850 and return through conduit 834 to the bottom of cylinder 802 through port 833. The metering valve 850 is adjustable and is used to control the rate of flow of fluid through the conduit. The system is filled with oil through fill port 878 and conduit 834, the oil entering through orifice 833 and rising until the lower portion of the bellows is filled with oil to a height slightly above the cover plate 820. When filled, the shut off valve 880 is closed. Oil from the inside of the bellows may flow into the cylinder through orifice 826 in the cover plate and through one or more slots 862, which are machined into the flange 805 of the cylinder 804.

At the downward stroke of the ram the piston will move downward and oil, or other fluid, will be allowed to enter the space in the cylinder 804 above the piston until the ram reaches the bottom of the stroke, at which point the piston will be at the bottom of the cylinder. After the ram starts its travel upward the movable plate of the bellows will start to move upward, because of the air pressure within the bellows, and carry along with it the piston rod and piston. During the first portion of its travel, the piston will move with no restraint through the fluid. When the top of the piston reaches the lip 882 of the cylinder 804, it will try to compress the fluid and increase the fluid pressure within the cylinder, in the portion above the piston. When the pressure increases sufficiently, the annular ring 823 will snap upward and seal off the passageway 826, thus preventing fluid from the sump in the bellows entering through 826 into the space in the cylinder above the piston. The annular disc 823 will also move annular seal 854 upward to seal the clearance between the piston rod and the hole in coverplate 820. The annular disc 823 has a disk hole 828 which aligns with the orifice in the passage 830, allowing oil to pass from the top of the cylinder through passage 830 and out through the conduit 838 and through the gauge 840, the metering valve 850 and return to the bottom of the cylinder 802. By adjusting the metering valve 850, the rate of flow of oil from the top of the cylinder through the conduit can be set to a desired value, thus determining the velocity of the piston in the upward direction.

The metering valve may be motorized and its position determined through a programmable controller or computer control by which means one will be able to define a desired program of piston velocity versus ram position, so as to optimize the return of the cushion to its topmost position with the least possible shock to the system.

For those operations that do not require variations in the rate of travel of the piston, the gauge 840 and the metering valve 850 may be removed and replaced by a fixed orifice suited to the particular operation. Oil during the upward travel of the piston will then pass through the orifice at the desired rate and flow directly into the lower part of the cylinder 804. By the above means the shock and impact on the dies and other parts of the press may be reduced substantially, and thus increase the life of the dies and those parts of the press, which may otherwise be damaged and reduced in life.

The valve 850 is very useful in fine tuning transfer press operations. Transfer presses are used in high speed assembly lines and are required to be operated at high rates of speed and to be automatically loaded and unloaded. Any inconsistency or shock on the upstroke of the transfer press will cause problems of misalignment of parts, damage to parts, variation in parts, and will cause stoppage of the press and the assembly line in order to make corrections to the press.

Figure 37:
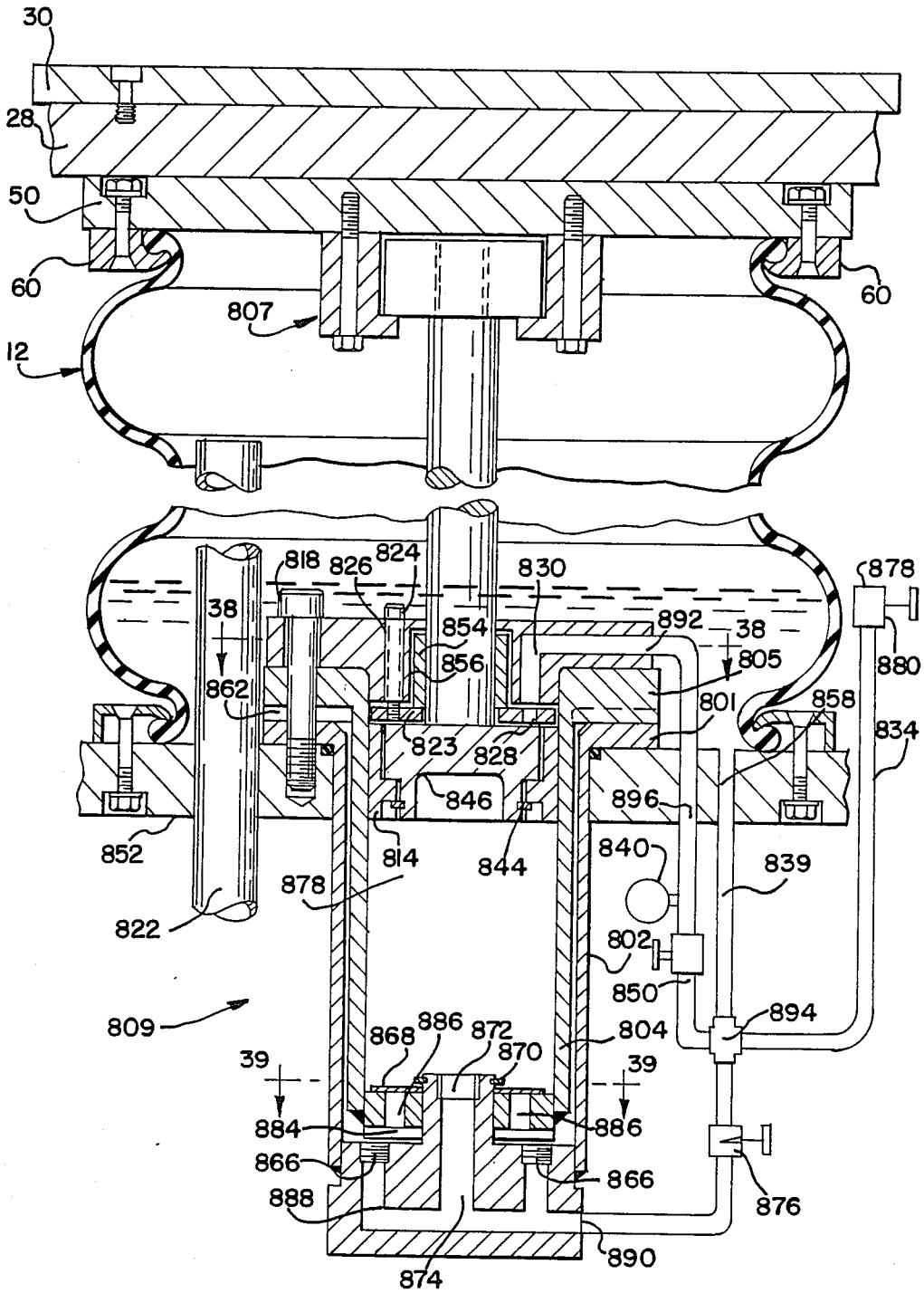
FIG. 37 is a cross sectional view of a die cushion incorporating a snubber and intensifier.
Figure 38:
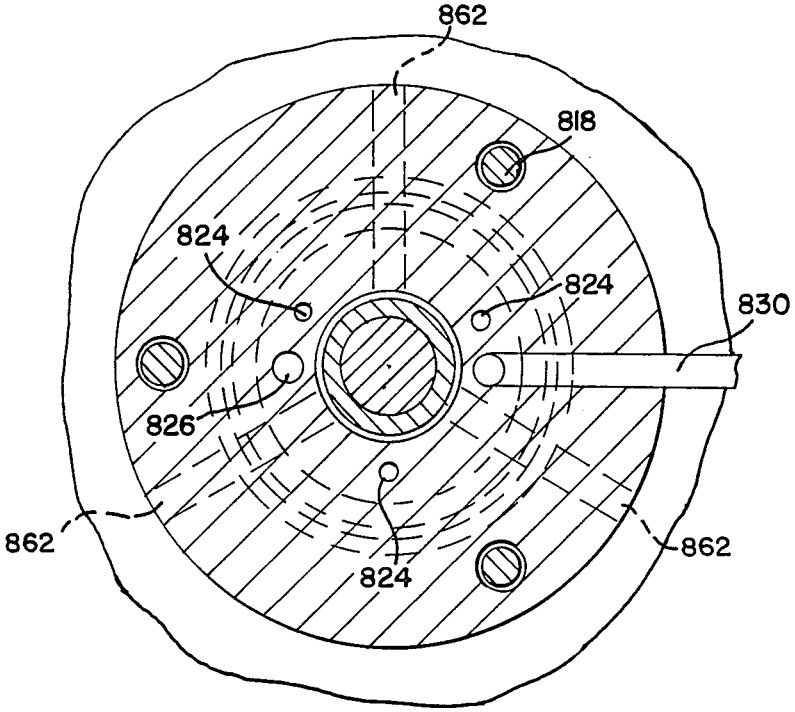
FIG. 38 is a cross sectional view taken on Line 38—38 of FIG. 37.
Figure 39:
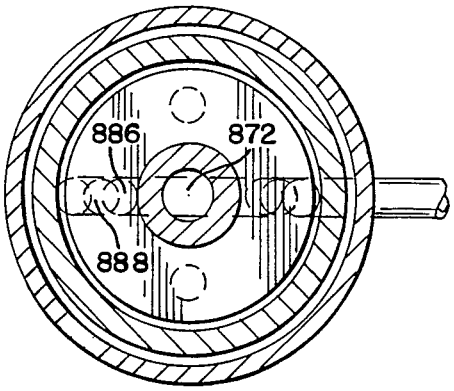
FIG. 39 is a cross sectional view taken on Line 39—39 of FIG. 37.

FIG. 37 illustrates the combination, 809, of the above hydraulic snubber with a hydraulic intensifier. During the upward stroke of the piston the snubber functions as described above with the exception that the upward motion of the piston is controlled during its complete travel from bottom to top of the cylinder through the settings of the metering valve 850. As the piston moves upward, oil will flow from the bellows through slot 862 through the space between the two cylinders and through passageways 884 and relief passageways 886, causing annular disc 868 to lift and allow oil to flow into the bottom of cylinder 804. As the piston assembly, consisting of piston ring 814 held in place on piston body 846 by retaining ring 844, starts to move downward the annular disc 823 will drop, opening up passageway 826, and oil will flow through passageway 826 from the sump at the bottom of the bellows into the space at the top of the cylinder above the piston. The downward push of the piston increases the pressure of the oil in the space 878 beneath the piston, causing annular ring 868 to close passageway 886. With the metering valve 876 open, oil will flow through the orifice 872, through the passageway 874, through the metering valve 876 and return through conduit 839 to the sump within the bellows through the passageway 858 into the sump within the bellows. The pressure within the space in the cylinder under the piston will depend upon the rate of flow of the oil out of the bottom of the cylinder, which will depend upon the adjustment of the metering valve 876.

Any desired program of pressure within the lower portion of the cylinder may be obtained by programming the position of the metering valve through a programmable controller or computer controller, which controls the positioning of the metering valve 876. The force under the piston adds to the force being exerted by the air inside the bellows on the movable plate of the bellows, and, thus increases the force on the die parts which hold the workpiece, which is being formed. Through the use of the intensifier, the optimum holding force for the workpiece may be obtained during the complete pressing operation of complex parts.

There are many press applications that are not critical, which do not require the fine tuning and programmed variations in snubber and intensifier action during the operation of the press. For these applications the metering valves 850 and 876 and gauge 840 are not required and may be removed along with the conduits leading to the opening 892 of passageway 830, the opening 890 of passageway 888 and two ports of the 4-way pipe coupling 894. Plugs 866 are also removed and plugs are inserted into openings 890, 896 and the two openings in connector 894 from which the conduits leading to the metering valves were removed. Fixed orifices are inserted into openings 892 and 872, the size of the orifice depending upon the application of the press.

On the downstroke of the press, oil from the inside of cylinder 804 is forced by the action of the piston to flow only through the fixed orifice, which has been placed in opening 872, inasmuch as the high oil pressure created by the piston pushing downward causes annular ring 868 to seal the passageways 886. The oil flows from the fixed orifice in 872 through passage 874, upward through passages 888 through passages 884 and then upward through the space between the two cylinders 802 and 804, and returns to the sump in the bellows through slots 862. During the downward stroke the oil pressure per unit area on the underside of the piston may be 2000 P.S.I. or 141 K.G. per square centimeter as against a pressure of 100 P.S.I. or 7.05 Kilograms per square centimeter inside the air cushion bellows. The force holding the workpiece will be the sum of the force created by the air cushion and the force created by the intensifier action.

For example, when using a 10" (25.4 cm) diameter bellows and a 2.5" (6.35 cm) diameter piston with a 1" (2.54 cm) piston rod, an air pressure of 100 P.S.I. (7.05 KG per square centimeter) and an oil pressure of 2000 P.S.I. (141 KG per square centimeter) developed in the lower part of the cylinder, the force holding the workpiece will be 7775 pounds (3534 KG), due to the air under pressure in the bellows to which is added 9820 pounds (4463 KG), due to the force exerted by the oil. The actual oil pressure will of course depend upon the size of the opening in the fixed orifice selected for each particular application.

Although specific embodiments of the herein disclosed invention have been shown in the accompanying drawings and described in detail above, it is readily apparent that those skilled in the art may make various alterations and changes without departing from the spirit and scope of the present invention. It is to be expressly understood that the instant invention is limited only by the appended claims.

What is claimed is:

1. A pneumatic die cushion for use in a power press comprising, in combination, a pair of substantially parallel spaced plates, each of said plates being adapted for attachment to a separate portion of a power press, one of said plates being movable in a vertical direction relative to the other plate, a resilient pneumatic bellows mounted between the plates resiliently connecting the spaced plates, a hydraulic snubber actuator connected to the spaced plates, said hydraulic snubber actuator including a cylinder connected to a selected spaced plate, a piston slideably mounted in the cylinder, a piston rod having one end connected to the piston and the other end connected to the other of the spaced plates, a cover plate sealingly connected to one end of the cylinder slideably receiving the piston rod, said cover plate sealingly closing the one end of the cylinder, said cover plate having a control passage connected to the interior of the cylinder, and a metering valve connected to the control passage to regulate the flow of hydraulic fluid liquid from the interior of the cylinder out through the passage for regulating the movement of the spaced plates away from each other.

2. A pneumatic die cushion for use in a power press as defined in claim 1, wherein the resilient pneumatic bellows has a portion filled with a hydraulic fluid to act as a sump for hydraulic fluid in the cylinder, said cover plate positioned in a lower portion of the sump and having a hydraulic fluid hole to allow hydraulic fluid to flow from the sump into the interior of the cylinder, and a valve cooperative with the hydraulic fluid hole to allow hydraulic fluid from the sump to enter the cylinder as the piston moves away from the cover plate but close the hydraulic fluid hole when the piston moves toward the cover plate.

3. A pneumatic die cushion for use in a power press as defined in claim 1, including an outer elongated cylinder surrounding the first mentioned cylinder, said outer cylinder having an annular flange on one end sealingly connected to the cover plate, said pneumatic bellows having a portion filled with hydraulic fluid to act as a sump for hydraulic fluid in the cylinder, a slot in the annular flange providing a flow path from the interior of the outer cylinder to the sump to allow hydraulic fluid to flow between the sump and the interior of the outer cylinder, a closure on the other end of the outer cylinder to seal closed that end of the cylinder, and said closure having a port connected to the metering valve.

4. A pneumatic die cushion for use in a power press as defined in claim 1, wherein the resilient pneumatic bellows has a portion filled with a hydraulic fluid to act as a sump for hydraulic fluid in the cylinder, said cover plate positioned in a lower portion of the sump and having a hydraulic fluid hole to allow hydraulic fluid to flow from the sump into the interior of the cylinder, and an annular disk mounted on the cover plate between the cover plate and the piston, said annular disk being sealingly engageable with the cover plate to seal closed the hydraulic fluid hole when the piston moves toward the cover plate.

5. A pneumatic die cushion for use in a power press as defined in claim 1, including an outer elongated cylinder surrounding the first mentioned cylinder, said outer cylinder having an annular flange on one end sealingly connected to the cover plate, said pneumatic bellows having a portion filled with hydraulic fluid to act as a sump for hydraulic fluid in the cylinder, a slot in the annular flange providing a flow path from the interior of the outer cylinder to the sump to allow hydraulic fluid to flow between the sump and the interior of the outer cylinder, a closure on the other end of the outer cylinder to seal closed that end of the cylinder, said closure having a port connected to the metering valve, and a fill valve connected to the port, said fill valve being on substantially the same horizontal plane as a selected level of hydraulic fluid in the sump.

6. A pneumatic die cushion for use in a power press as defined in claim 1, including an outer elongated cylinder surrounding the first mentioned cylinder, said outer cylinder having an annular flange on one end sealingly connected to the cover plate, said pneumatic bellows having a portion filled with hydraulic fluid to act as a sump for hydraulic fluid in the cylinder, a slot in the annular flange providing a flow path from the interior of the outer cylinder to the sump to allow hydraulic fluid to flow between the sump and the interior of the outer cylinder, a closure on the other end of the outer cylinder to seal closed that end of the cylinder, said closure having a port connected to the metering valve, said cover plate positioned in a lower portion of the sump and having a hydraulic fluid hole to allow hydraulic fluid to flow from the sump into the interior of the cylinder, and a valve cooperative with the hydraulic fluid hole to allow hydraulic fluid from the sump to enter the cylinder as the piston moves away from the cover plate but close the hydraulic fluid hole when the piston moves toward the hydraulic cover plate.

7. A pneumatic die cushion for use in a power press as defined in claim 1, including an outer elongated cylinder surrounding the first mentioned cylinder, said outer cylinder having an annular flange on one end sealingly connected to the cover plate, said pneumatic bellows having a portion filled with hydraulic fluid to act as a sump for hydraulic fluid in the cylinder, a slot in the annular flange providing a flow path from the interior of the outer cylinder to the sump to allow hydraulic fluid to flow between the sump and the interior of the outer cylinder, a closure on the other end of the outer cylinder to seal closed that end of the cylinder, said closure having a port connected to the metering valve, said cover plate positioned in a lower portion of the sump and having a hydraulic fluid hole to allow hydraulic fluid to flow from the sump to the interior of the cylinder, and an annular disk mounted on the cover plate between the cover plate and the piston, said annular disk being sealingly engageable with the cover plate to seal closed the hydraulic fluid hole when the piston moves toward the cover plate.

8. A pneumatic die cushion for use in a power press as defined in claim 1, including an outer elongated cylinder surrounding the first mentioned cylinder, said outer cylinder having an annular flange on one end sealingly connected to the cover plate, said pneumatic bellows having a portion filled with hydraulic fluid to act as a sump for hydraulic fluid in the cylinder, a slot in the annular flange providing a flow path from the interior of the outer cylinder to the sump to allow hydraulic fluid to flow between the sump and the interior of the outer cylinder, a closure on the other end of the outer cylinder to seal closed that end of the cylinder, said closure having a port connected to the metering valve, said cover plate positioned in a lower portion of the sump and having a hydraulic fluid hole to allow hydraulic fluid to flow from the sump into the interior of the cylinder, an annular disk mounted on the cover plate between the cover plate and the piston, said annular disk being sealingly enagageable with the cover plate to seal closed the hydraulic fluid hole when the piston moves toward the cover plate, and a fill valve connected to the port, said fill valve being on substantially the same horizontal plane as a selected level of hydraulic fluid in the sump.

9. A pneumatic die cushion for use in a power press as defined in claim 1, wherein the resilient pneumatic bellows has a portion filled with a hydraulic fluid to act as a sump for hydraulic fluid in the cylinder, said cover plate positioned in a lower portion of the sump and having a hydraulic fluid hole to allow hydraulic fluid to flow from the sump into the interior of the cylinder, a valve cooperative with the hydraulic fluid hole to allow hydraulic fluid from the sump to enter the cylinder when the piston moves away from the cover plate but close the hydraulic fluid hole when the piston moves toward the cover plate, and a fill valve connected to the sump, said fill valve being on substantially the same horizontal plane as a selected level of hydraulic fluid in the sump.

10. A pneumatic die cushion for use in a power press comprising, in combination, a pair of substantially parallel spaced plates, each of said plates being adapted for attachment to a separate portion of a power press, one of said plates being movable in a vertical direction relative to the other plate of the pair of plates, a resilient pneumatic bellows mounted between the plates resiliently connecting the spaced plates, an elongated cylinder having one end sealingly closed and the other end sealingly connected to the interior of the resilient pneumatic bellows, said cylinder having its other end sealingly connected to a selected one of the pair of spaced plates, a cover plate sealingly connected to said other end of the cylinder and positioned within the bellows, a piston slideably mounted in the cylinder, a piston rod having one end connected to the piston and the other end connected to the other of the pair of spaced plates, and an orifice in the end of the cylinder to allow hydraulic fluid to be expelled from the cylinder by the piston as plates move toward each other to cooperate with the bellows for regulation of movement of the plates toward each other.

11. A pneumatic die cushion for use in a power press as defined in claim 10, including a metering valve connected to the orifice in the end of the cylinder to regulate the flow of hydraulic fluid from the cylinder for regulation of movement of the spaced plates toward each other.

12. In a pneumatic die cushion for use in a power press as defined in claim 10, including, a swivel assembly connecting the other end of the piston rod with the other of the spaced plates to allow adjustment between the other end of the piston rod and the other of the spaced plates.

13. A pneumatic die cushion for use in a power press as defined in claim 10, including a sump in the bellows for holding hydraulic fluid in the bellows, and said orifice connected to the sump by a conduit, whereby movement of the piston toward the orifice forces hydraulic fluid out of the cylinder to return to the sump.

14. A pneumatic die cushion for use in a power press as defined in claim 10, including, a sump in the bellows for holding hydraulic fluid in the bellows, said cylinder having a relief passage in its closed end connecting the interior of the cylinder with the sump positioned in the bellows, and a valve connected to the relief passage for regulating flow of hydraulic fluid through the relief passage, causes the valve to close and discharge of hydraulic fluid is effected only through the orifice and movement of the piston away from the relief passage causes the valve to open and to allow hydraulic fluid from the sump to enter the cylinder.

15. A pneumatic die cushion for use in a power press as defined in claim 10, wherein a sump for hydraulic fluid is positioned in the pneumatic bellows, a metering valve is connected to the orifice to regulate the flow of hydraulic fluid out of the cylinder, and a conduit connects the metering valve with the sump to discharge hydraulic fluid from the cylinder to the sump.

16. A pneumatic die cushion for use in a power press as defined in claim 10, including, a swivel assembly connecting the other end of the piston rod to the other of the spaced plates, a sump in the pneumatic bellows for retaining hydraulic fluid, an outer cylinder surrounding the first mentioned cylinder providing a flow path for hydraulic fluid, said outer cylinder having a slot providing a flow path between the interior of the outer cylinder and the sump, a relief passage through the first mentioned cylinder into the interior of the outer cylinder, a valve connected to said relief passage to control the flow of hydraulic fluid out of the first mentioned cylinder, a metering valve connected to the orifice to regulate the flow of hydraulic fluid out of the interior of the first mentioned cylinder, and a conduit connected to the metering valve to provide a flow path for hydraulic fluid from the metering valve to the sump.

17. A pneumatic die cushion for use in a power press as defined in claim 10, wherein the cover plate includes a control passage to provide a flow path from the interior of the cylinder for hydraulic fluid forced out of the cylinder as the piston moves toward the cover plate, and a discharge metering valve connected to the control passage to regulate the flow of hydraulic fluid out of the interior of the cylinder as the piston moves toward the cover plate to regulate the rate of separation of the spaced plates.

18. A pneumatic die cushion for use in a power press as defined in claim 10, wherein the cover plate includes a control passage to provide a hydraulic fluid flow path out from the interior of the cylinder for hydraulic fluid forced out of the cylinder as the piston moves toward the cover plate, and a disk valve movably engageable with the cover plate, said disk valve having a disk hole aligned with the control passage to regulate the flow of fluid out of the interior of the cylinder as the piston moves toward the cover plate.

19. A pneumatic die cushion for use in a power press as defined in claim 10, including, a sump in the bellows for holding hydraulic fluid in the bellows, said cover plate having a hydraulic fluid hole connecting the interior of the cylinder to the sump, said cover plate including a control passage to provide a hydraulic fluid flow path out from the interior of the cylinder for hydraulic fluid forced out of the cylinder, said control passage being connected to the sump, and an annular disk movably mounted on the cover plate positioned between the cover plate and the piston, said annular disk being sealingly engageable with the cover plate to seal closed the hydraulic fluid hole when the piston moves toward the cover plate, said annular disk having a disk hole substantially aligned with the control passage to permit the flow of hydraulic fluid out of the interior of the cylinder.

20. A pneumatic die cushion for use in a power press as defined in claim 10, including, a sump in the pneumatic bellows for retaining hydraulic fluid, an outer cylinder surrounding the first mentioned cylinder providing a flow path for hydraulic fluid between the cylinders, said outer cylinder having a slot providing a flow path between the interior of the outer cylinder and the sump, a relief passage through the first mentioned cylinder into the interior of the outer cylinder, a valve adjacent to said relief passage to control the flow of hydraulic fluid out of the first mentioned cylinder, and a bypass passage connecting the orifice with the interior of the outer cylinder to allow hydraulic fluid to flow from the orifice into the sump.

21. A pneumatic die cushion for use in a power press as defined in claim 10 including, a sump in the pneumatic bellows for retaining hydraulic fluid, an outer cylinder surrounding the first mentioned cylinder providing a flow path for hydraulic fluid between the cylinders, said outer cylinder having a slot providing a flow path between the interior of the outer cylinder and the sump, a relief passage through the first mentioned cylinder into the interior of the outer cylinder, a valve cooperative with said relief passage to control the flow of the hydraulic fluid out of the first mentioned cylinder through said relief passage, a metering valve connected to the orifice to regulate the flow of hydraulic fluid out of the interior of the first mentioned cylinder, a conduit connected to the metering valve providing a flow path from the metering valve to the sump, said cover plate having a control passage connected to the interior of the cylinder, said cover plate having a hydraulic fluid hole to allow hydraulic fluid to flow from the sump into the interior of the first mentioned cylinder, an annular disk movably mounted on the cover plate and positioned between the cover plate and the piston, said annular disk being sealingly engageable with the cover plate to seal closed the hydraulic fluid hole when the piston moves toward the cover plate, said annular disk having a disk hole aligned with the control passage to allow hydraulic fluid to flow into the control passage when the annular disk is positioned in engagement with the cover plate to close the hydraulic fluid hole, a discharge metering valve connected to the control passage to regulate the flow of hydraulic fluid from the interior of the first mentioned cylinder out through the control passage, and a discharge conduit connecting the discharge metering valve with the sump providing a path for flow of hydraulic fluid from the discharge metering valve to the sump.

22. In a power press having; a frame, said frame having a base, a ram movably mounted on the frame, drive means connected to the ram for moving the ram in a power stroke toward the base and a return stroke away from the base, a die set, said die set having a ram portion connected to the ram for movement with the ram, said die set having a die base portion connected to the base, said die base portion having a movable die plate adapted for movement with the ram portion, the improvement comprising; a pneumatic die cushion connected to said frame, said pneumatic die cushion including a pair of substantially parallel spaced cushion plates, a selected cushion plate connected to the die plate, a resilient pneumatic bellows mounted between the cushion plates resiliently holding the cushion plates spaced apart, a plurality of limiter pins releasably secured to one of said spaced cushion plates, each of said limiter pins having a threaded end threadedly mounted in the one of said cushion plates, each of said limiter pins having turning means on the end having the threaded end adapted for releasably threadedly mounting each limiter pin in the one cushion plate, each of said limiter pins being movable relative to the other of said cushion plates, stop means mounted on the other end of each limiter pin adjacent to the other of said cushion plates limiting the movement in one direction the movement of the first mentioned cushion plate relative to the other cushion plate, and a limit sleeve mounted on each of the limiter pins to control the minimum spacing between the cushion plates; and a pneumatic counterbalance mounted on the frame for holding certain parts of the press in the same relative engagement during the return stroke of the ram as during the power stroke of the ram, said pneumatic counterbalance including, a fixed counterbalance plate connected to a part of the press, a resilient pneumatic counterbalance bellows having opposed open ends, said pneumatic counterbalance bellows having one end connected to the fixed counterbalance plate, a movable counterbalance plate connected to the opposite end of the pneumatic counterbalance bellows, and a connector rod connected to the movable counterbalance plate and to another part of the press, whereby movement of the movable counterbalance plate toward the fixed counterbalance plate compresses air within the pneumatic counterbalance bellows and the compressed air urges the movable counterbalance plate away from the fixed counterbalance plate when the movable counterbalance plate moves away from the fixed counterbalance plate to hold certain parts of the press in the same relative engagement as during the movement of the movable counterbalance plate toward the fixed counterbalance plate.

23. In a power press as defined in claim 22, including, an elongated cylinder having one end sealingly closed, the other end of the elongated cylinder sealingly connected to the interior of the resilient pneumatic bellows and to a selected one of the pair of spaced cushion plates, a cover plate sealingly connected to the other end of the cylinder and positioned within the bellows, a piston slideably mounted in the cylinder, a piston rod having one end connected to the piston and the other end connected to the other of the pair of spaced cushion plates, and an orifice in the end of the cylinder to allow hydraulic fluid to be expelled from the cylinder by the piston as the cushion plates move toward each other to cooperate with the cushion bellows for regulation of movement of the cushion plates toward each other.

24. In a power press having; a frame, said frame having a base, a ram movably mounted on the frame, drive means connected to the ram for moving the ram toward the base and away from the base, a die set, said die set having a ram portion connected to the ram for movement with the ram, said die set having a die base portion connected to the base, said die base portion having a movable die plate adapted for movement with the ram portion, the improvement comprising; a pneumatic die cushion connected to said frame, said pneumatic die cushion including a pair of substantially parallel spaced cushion plates, one of said cushion plates connected to the movable die plate, a resilient pneumatic bellows mounted between the cushion plates resiliently holding the cushion plates spaced apart, a plurality of limiter pins releasably secured to one of said spaced cushion plates, each of said limiter pins having a threaded end threadedly mounted in said one of said cushion plates, each of said limiter pins having turning means on the end having the threaded end adapted for releasably threadedly mounting each limiter pin in the one cushion plate, each of said limiter pins being movable relative to the other of said cushion plates, stop means mounted on the other end of each limiter pin adjacent to the other of said cushion plates limiting the movement in one direction the movement of the first mentioned cushion plate relative to the other cushion plate, and a limit sleeve mounted on each of the limiter pins to control the minimum spacing between the cushion plates, an elongated cylinder having one end sealingly closed and the other end sealingly connected to the interior of the resilient pneumatic bellows and to one of the pair of spaced cushion plates, a cover plate sealingly connected to the other end of the cylinder and positioned within the bellows, a piston slideably mounted in the cylinder, a piston rod having one end connected to the piston and the other end connected to the other of the pair of spaced cushion plates, and an orifice in the end of the cylinder to allow hydraulic fluid to be expelled from the cylinder by the piston as the cushion plates move toward each other to cooperate with the bellows for regulation of movement of the cushion plates toward each other.

25. In a power press having; a frame, said frame having a base, a ram movably mounted on the frame, drive means connected to the ram for moving the ram toward the base and away from the base, a die set, said die set having a ram portion connected to the ram for movement with the ram, said die set having a die base portion connected to the base, said die base portion having a movable die plate adapted for movement with the ram portion, the improvement comprising; a pneumatic die cushion connected to said frame, said pneumatic die cushion including a pair of substantially parallel spaced cushion plates, a selected one of said cushion plates connected to the die plate, a resilient pneumatic cushion bellows mounted between the cushion plates resiliently holding the cushion plates spaced apart, a plurality of limiter pins releasably secured to one of said spaced cushion plates, each of said limiter pins having a threaded end threadedly mounted in one of said cushion plates, each of said limiter pins having turning means on the end having the threaded end adapted for releasably threadedly mounting the limiter pins in the one cushion plate, each of said limiter pins being movable relative to the other of said cushion plates, stop means mounted on the other end of each limiter pin adjacent to the other of said cushion plates limiting the movement in one direction the movement of the first mentioned cushion plate relative to the other cushion plate, and a limit sleeve mounted on each of the limiter pins to control the minimum spacing between the cushion plates; and a pneumatic counterbalance mounted on the frame for holding certain parts of the press in the same relative engagement during the return stroke of the ram as during the power stroke of the ram, said pneumatic counterbalance including, a first counterbalance plate connected to a first part of the press, an elongated cylindrical tube having one end mounted on the first counterbalance plate and having its center axis substantially perpendicular to the counterbalance plate, a resilient tubular counterbalance bellows for holding air having a pair of opposed open ends, said counterbalance bellows having an elongated tubular resilient sleeve connecting the open ends and formed integral therewith, one of the open ends of the counterbalance bellows sealingly connected to the tube, a first portion of the tubular sleeve surrounding a portion of the other end of the tube, a second portion of the tubular sleeve connected to the first portion of the tubular sleeve by a fold in the sleeve and having a part surrounding the first portion, and a second counterbalance plate connected to the other open end of the counterbalance bellows, said second counterbalance plate connected to a second part of the press movable relative to the first part of the press, said first counterbalance plate and the second counterbalance plate being movable relative to each other, whereby movement of the counterbalance plates toward each other places a part of the second portion of the tubular sleeve in engagement with an additional portion of the tube adjacent to the first portion of the tubular sleeve and air contained in the counterbalance bellows is compressed.

26. In a power press having; a frame, said frame having a base, a ram movably mounted on the frame, drive means connected to the ram for moving the ram in a power stroke toward the base and a return stroke away from the base, a die set, said die set having a ram portion connected to the ram for movement with the ram, said die set having a die base portion connected to the base, said die base portion having a movable die plate adapted for movement with the ram portion, the improvement comprising; a pneumatic die cushion connected to said frame, said die cushion having a fixed cushion plate connected to the base of the press, a resilient cushion bellows having one end sealingly connected to the fixed cushion plate, said cushion bellows having an opposite end sealingly connected to a movable cushion plate, said movable cushion plate connected to the movable die plate, a resilient pneumatic snubber actuator having one end fixed relative to the fixed cushion plate, said snubber actuator having an opposite movable end connected to the movable cushion plate for affecting the rate of movement of the movable cushion plate, and means allowing fluid to flow into the snubber actuator when the movable cushion plate moves toward the snubber actuator; and a pneumatic counterbalance for holding certain parts of the press in the same relative engagement during the return stroke of the ram as during the power stroke of the ram, said counterbalance including, a fixed counterbalance plate connected to one part of the power press, a movable counterbalance plate, a plurality of interconnected resilient pneumatic counterbalance bellows positioned between the fixed counterbalance plate and the movable counterbalance plate, a bellows connector sealingly connected to each pair of adjacent ends of adjacent pneumatic counterbalance bellows for sealingly connecting the pneumatic counterbalance bellows to each other, a connector rod having one end secured to the movable counterbalance plate, said connector rod having its other end connected to another part of the press, whereby movement of the movable counterbalance plate toward the fixed counterbalance plate compresses air within the plurality of interconnected pneumatic counterbalance bellows and the compressed air urges the movable counterbalance plate away from the fixed counterbalance plate when the movable counterbalance plate moves away from the fixed counterbalance plate to hold certain parts of the press in the same relative engagement as during movement of the movable counterbalance plate toward the fixed counterbalance plate.

27. In a power press having; a frame, said frame having a base, a ram movably mounted on the frame, drive means connected to the ram for moving the ram in a power stroke toward the base and a return stroke away from the base, a die set, said die set having a ram portion connected to the ram for movement with the ram, said die set having a die base portion connected to the base, said die base portion having a movable die plate adapted for movement with the ram portion, the improvement comprising; a pneumatic die cushion connected to said frame, said pneumatic die cushion including a pair of substantially parallel spaced cushion plates, each of said cushion plates being adapted for attachment to a separate portion of the power press, one of said cushion plates being movable in a vertical direction relative to the other cushion plate, a resilient pneumatic cushion bellows mounted between the cushion plates resiliently connecting the spaced cushion plates, a hydraulic snubber actuator connected to the spaced cushion plates, said hydraulic snubber actuator including a cylinder connected to a selected spaced cushion plate, a piston slideably mounted in the cylinder, a piston rod having one end connected to the piston and the other end connected to the other of the spaced cushion plates, a cover plate sealingly connected to one end of the cylinder slideably receiving the piston rod, said cover plate sealingly closing the one end of the cylinder, said cover plate having a control passage connected to the interior of the cylinder, and a metering valve connected to the control passage to regulate the flow of hydraulic fluid from the interior of the cylinder out through the passage for regulating the movement of the spaced cushion plates away from each other; and a pneumatic counterbalance connected to the press for holding certain parts of the press in the same relative engagement during the return stroke of the ram of the press as during the power stroke of the ram, said counterbalance including a fixed counterbalance plate connected to a part of the press, a resilient pneumatic counterbalance bellows having opposed open ends, said pneumatic bellows having one end connected to the fixed counterbalance plate, a movable counterbalance plate connected to the opposite end of the pneumatic counterbalance bellows, and a counterbalance connector rod connected to the movable counterbalance plate and to another part of the press, whereby movement of the movable counterbalance plate toward the fixed counterbalance plate compresses air within the pneumatic counterbalance and the compressed air urges the movable counterbalance plate away from the fixed counterbalance plate when the movable counterbalance plate moves away from the fixed counterbalance plate to hold certain parts of the press in the same relative engagement as during the movement of the movable counterbalance plate toward the fixed counterbalance plate.

28. In a power press having; a frame, said frame having a base, a ram movably mounted on the frame, drive means connected to the ram for moving the ram in a power stroke toward the base and a return stroke away from the base, a die set, said die set having a ram portion connected to the ram for movement with the ram, said die set having a die base portion connected to the base, said die base portion having a movable die plate adapted for movement with the ram portion, the improvement comprising; a pneumatic die cushion connected to said frame, said pneumatic die cushion including a pair of substantially parallel spaced cushion plates, each of said cushion plates being adapted for attachment to a separate portion of the power press, one of said cushion plates being movable in a vertical direction relative to the other cushion plate, a resilient pneumatic cushion bellows mounted between the cushion plates resiliently connecting the spaced cushion plates, an elongated cylinder having one end sealingly closed, the other end of the cylinder sealingly connected to the interior of the resilient pneumatic cushion bellows and to a selected one of the pair of spaced cushion plates, a cover plate sealingly connected to the other end of the cylinder and positioned within the cushion bellows, a piston slideably mounted in the cylinder, a piston rod having one end connected to the piston and the other end connected to the other of the pair of spaced cushion plates, an orifice in the end of the cylinder to allow a hydraulic fluid to be expelled from the cylinder by the piston as the cushion plates move toward each other to cooperate with the cushion bellows for regulation of movement of the cushion plates toward each other, a sump for hydraulic fluid positioned in the pneumatic cushion bellows, a metering valve connected to the orifice to regulate the flow of hydraulic fluid out of the cylinder, and a conduit connecting the metering valve with the sump to discharge hydraulic fluid from the cylinder to the sump; and a pneumatic counterbalance holding selected parts of the press in the same relative engagement during the return stroke of the ram as during the power stroke of the ram, said counterbalance having a first counterbalance plate connected to a first part of the press, an elongated cylindrical tube having one end mounted on the first counterbalance plate and having a center axis substantially perpendicular to the first counterbalance plate, a resilient tubular counterbalance bellows for holding air having a pair of opposed open ends, said counterbalance bellows having an elongated tubular resilient sleeve connecting the open ends and formed integral therewith, one of the open ends of the counterbalance bellows sealingly connected to the tube, a first portion of the tubular sleeve surrounding a portion of the other end of the tube, a second portion of the tubular sleeve connected to the first portion of the tubular sleeve by a fold in the sleeve and having a part surrounding the first portion, and a second counterbalance plate connected to the other open end of the counterbalance bellows, said second counterbalance plate connected to a second part of the press movable relative to the first part of the press, said first counterbalance plate and the second counterbalance plate being movable relative to each other, whereby movement of the counterbalance plates toward each other places a part of the second portion of the tubular sleeve in engagement with an additional portion of the tube adjacent to the first portion of the tube and air contained in the counterbalance bellows is compressed.

29. In a power press having; a frame, said frame having a base, a ram movable mounted on the frame, drive means connected to the ram for moving the ram in a power stroke toward the base and a return stroke away from the base, a die set, said die set having a ram portion connected to the ram for movement with the ram, said die set having a die base portion connected to the base, said die base portion having a movable die plate adapted for movement with the ram portion, the improvement comprising; a pneumatic die cushion connected to said frame, said pneumatic die cushion including a pair of substantially parallel spaced cushion plates, each of said cushion plates being adapted for attachment to a separate portion of the power press, one of said cushion plates being movable in a vertical direction relative to the other cushion plate, a resilient pneumatic cushion bellows mounted between the cushion plates resiliently connecting the spaced cushion plates, an elongated cylinder having one end sealingly closed, the other end of the cylinder sealingly connected to the interior of the resilient pneumatic cushion bellows and to a selected one of the pair of spaced cushion plates, a cover plate sealingly connected to the other end of the cylinder and positioned within the bellows, a piston slideably mounted in the cylinder, a piston rod having one end connected to the piston and the other end connected to the other of the pair of spaced plates, an orifice in the end of the cylinder to allow a hydraulic fluid to be expelled from the cylinder by the piston as the cushion plates move toward each other to cooperate with the bellows for regulation of movement of the cushion plates toward each other, a sump in the pneumatic cushion bellows for retaining hydraulic fluid, an outer cylinder surrounding the first mentioned cylinder providing a flow path for hydraulic fluid between the cylinders, said outer cylinder having a slot providing a flow path between the interior of the outer cylinder and the sump, a relief passage through the first mentioned cylinder into the interior of the outer cylinder, a valve cooperative with said relief passage to control the flow of hydraulic fluid out of the first mentioned cylinder through said relief passage, a metering valve connected to the orifice to regulate the flow of hydraulic fluid out of the interior of the first cylinder, a conduit connected to the metering valve providing a flow path from the metering valve to the sump, said cover plate having a control passage connected to the interior of the cylinder, said cover plate having a plurality of hydraulic fluid holes to allow hydraulic fluid to flow from the sump into the interior of a first mentioned cylinder, an annular disk movably mounted on the cover plate and positioned between the cover plate and the piston, said annular disk being sealingly engageable with the cover plate to seal closed the hydraulic fluid holes when the piston moves toward the cover plate, said annular disk having a disk hole aligned with the control passage to allow hydraulic fluid to flow into the control passage when the annular disk is positioned in engagement with the cover plate to close the hydraulic fluid holes, a discharge metering valve connected to the control passage to regulate flow of hydraulic fluid from the interior of the cylinder out through the passage, and a discharge conduit connecting the discharge metering valve with the sump providing a path for flow of hydraulic fluid from the discharge metering valve to the sump; and a pneumatic counterbalance for holding certain parts of the press in the same relative engagement during the return stroke of the ram as during the power stroke of the ram, said counterbalance including a fixed counterbalance bellows adapted for connection to a part of the press, a resilient pneumatic counterbalance bellows having opposed open ends, said pneumatic counterbalance bellows having one end connected to the fixed counterbalance plate, a movable counterbalance plate connected to the opposite end of the pneumatic counterbalance bellows, and a connector rod connected to the movable counterbalance plate and to another part of the press, whereby movement of the movable counterbalance plate toward the fixed counterbalance plate compresses air within the pneumatic counterbalance bellows and the compressed air urges the movable counterbalance plate away from the fixed counterbalance plate when the movable counterbalance plate moves away from the fixed counterbalance plate to hold certain parts of the press in the same relative engagement as during the movement of the movable counterbalance plate toward the fixed counterbalance plate.

* * * * *

UNITED STATES PATENT AND TRADEMARK OFFICE

CERTIFICATE OF CORRECTION

PATENT NO. : 4,860,571

DATED : Aug. 29, 1989

INVENTOR(S) : Kenneth L. Smedberg, et al.

It is certified that error appears in the above-identified patent and that said Letters Patent are hereby corrected as shown below:

On the title page:

In the Abstract, Line 9, cancel "cyliinder" and substitute therefor --cylinder--.

Claim 14, Column 25, Line 23, after "passage," insert --whereby movement of the piston toward the relief passage"

Signed and Sealed this

Thirty-first Day of July, 1990

*Attest:*

HARRY F. MANBECK, JR.

*Attesting Officer*

*Commissioner of Patents and Trademarks*